US011365367B2

(12) United States Patent
Vincent et al.

(10) Patent No.: US 11,365,367 B2
(45) **Date of Patent: *Jun. 21, 2022**

(54) LUBRICATING COMPOSITION FOR AND METHOD OF LUBRICATING AN INTERNAL COMBUSTION ENGINE

(71) Applicant: The Lubrizol Corporation, Wickliffe, OH (US)

(72) Inventors: Paul R. Vincent, Belper (GB); Timothy R. Smith, Belper (GB); Eugene Pashkovski, Moreland Hills, OH (US); Reid A. Patterson, Euclid, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/626,128

(22) PCT Filed: Jun. 26, 2018

(86) PCT No.: PCT/US2018/039414

§ 371 (c)(1),
(2) Date: Dec. 23, 2019

(87) PCT Pub. No.: WO2019/005738

PCT Pub. Date: Jan. 3, 2019

(65) Prior Publication Data

US 2021/0147760 A1 May 20, 2021

Related U.S. Application Data

(60) Provisional application No. 62/525,360, filed on Jun. 27, 2017.

(51) Int. Cl.

| | |
|---|---|
| ***C10M 169/04*** | (2006.01) |
| ***C10M 145/14*** | (2006.01) |
| ***C10M 135/10*** | (2006.01) |
| ***C10M 137/16*** | (2006.01) |
| ***C10M 149/08*** | (2006.01) |
| ***C10M 157/04*** | (2006.01) |
| ***C10M 161/00*** | (2006.01) |
| *C10N 30/00* | (2006.01) |
| *C10N 20/00* | (2006.01) |
| *C10N 20/02* | (2006.01) |
| *C10N 30/02* | (2006.01) |
| *C10N 30/04* | (2006.01) |
| *C10N 30/06* | (2006.01) |
| *C10N 30/10* | (2006.01) |
| *C10N 40/25* | (2006.01) |

(52) U.S. Cl.

CPC ..... *C10M 169/044* (2013.01); *C10M 135/10* (2013.01); *C10M 137/16* (2013.01); *C10M 145/14* (2013.01); *C10M 149/08* (2013.01); *C10M 157/04* (2013.01); *C10M 161/00* (2013.01); *C10M 2209/02* (2013.01); *C10M 2209/084* (2013.01); *C10M 2217/06* (2013.01); *C10M 2219/022* (2013.01); *C10M 2219/044* (2013.01); *C10M 2223/043* (2013.01); *C10M 2290/00* (2013.01); *C10N 2020/02* (2013.01); *C10N 2020/073* (2020.05); *C10N 2030/02* (2013.01); *C10N 2030/04* (2013.01); *C10N 2030/06* (2013.01); *C10N 2030/10* (2013.01); *C10N 2030/40* (2020.05); *C10N 2040/25* (2013.01)

(58) Field of Classification Search

CPC ..... C10M 169/044; C10M 145/14; C10M 149/08; C10M 157/04; C10M 161/00; C10M 2209/084; C10M 2219/022; C10N 2020/02; C10N 2030/40

See application file for complete search history.

(56) References Cited

U.S. PATENT DOCUMENTS

| | | | | |
|---|---|---|---|---|
| 4,537,697 | A | 8/1985 | Girard | |
| 5,955,405 | A | 9/1999 | Liesen et al. | |
| 7,632,788 | B2 | 12/2009 | Jao et al. | |
| 7,691,797 | B2 | 4/2010 | Schmidt et al. | |
| 7,790,661 | B2 * | 9/2010 | Covitch | C10M 149/10 508/528 |

(Continued)

FOREIGN PATENT DOCUMENTS

| | | | |
|---|---|---|---|
| CN | 102272278 | A | 12/2011 |
| CN | 104245906 | A | 12/2014 |

(Continued)

OTHER PUBLICATIONS

Sogah, Dotsevi Y., et al., Group Transfer Polymerization. Polymerization of Acrylic Monomers, Macromolecules, 1987, pp. 1473-1488, vol. 20, No. 7, American Chemical Society, Wilmington, Delaware.

Nakagawa, Osamu, et al., Preparation of Highly Syndiotactic Block Copolymers of Methyl Methacrylate and Lauryl Methacrylate and their Characterization, Polymer Bulletin, Sep. 7, 1992, pp. 579-586, Springer-Verlag, Osaka, Japan.

Patrickios, C.S., et al., Diblock, ABC Triblock, and Random Methacrylic Polyampholytes: Synthesis by Group Transfer Polymerization and Solution Behavior, Macromolecules, 1994, pp. 930-937, American Chemical Society, Cambridge, Massachusetts.

(Continued)

*Primary Examiner* — Ellen M McAvoy

(74) *Attorney, Agent, or Firm* — Eryn Ace Fuhrer; Teresan W. Gilbert

(57) ABSTRACT

The invention provides a lubricating composition comprising a low viscosity base oil and a synergistic mixture of a functionalized ethylene-α-olefin copolymer, a poly(meth) acrylate polymer, and a metal-free anti-wear agent. The invention also provides a method of lubricating an internal combustion engine using such a lubricating composition.

31 Claims, No Drawings

(56) References Cited

U.S. PATENT DOCUMENTS

| | | | | |
|---|---|---|---|---|
| 2006/0025316 | A1* | 2/2006 | Covitch | C10M 133/56 508/459 |
| 2006/0079413 | A1 | 4/2006 | Kocsis et al. | |
| 2007/0244018 | A1* | 10/2007 | Visger | C08F 293/005 508/545 |
| 2007/0254820 | A1 | 11/2007 | Jao et al. | |
| 2011/0263470 | A1* | 10/2011 | Qin | C10M 149/06 508/507 |
| 2012/0220506 | A1* | 8/2012 | Qin | C10M 145/14 508/287 |
| 2012/0329694 | A1* | 12/2012 | Gelder | C10M 119/24 508/468 |
| 2015/0183915 | A1* | 7/2015 | Johnson | C08F 220/18 508/469 |
| 2015/0197705 | A1* | 7/2015 | Matsui | C10M 161/00 508/364 |
| 2015/0203785 | A1* | 7/2015 | Matsui | C10M 161/00 508/186 |
| 2016/0264908 | A1* | 9/2016 | Jones | C10M 133/04 |
| 2016/0280811 | A1* | 9/2016 | Proust | C10M 149/06 |
| 2017/0009178 | A1* | 1/2017 | Akamatsu | C10M 157/00 |
| 2017/0088789 | A1* | 3/2017 | Grisso | C10M 157/04 |
| 2018/0327687 | A1* | 11/2018 | Kwak | C10M 145/20 |
| 2018/0371357 | A1* | 12/2018 | Knapton | C10M 149/18 |
| 2020/0115649 | A1 | 4/2020 | Patterson et al. | |

FOREIGN PATENT DOCUMENTS

| | | | |
|---|---|---|---|
| EP | 0338672 | A1 | 10/1989 |
| EP | 2333037 | A1 | 6/2011 |
| EP | 2878659 | A1 | 6/2015 |
| EP | 2990469 | A1 | 3/2016 |
| WO | 2007068102 | A2 | 6/2007 |
| WO | 2007131086 | A3 | 11/2007 |
| WO | 2011146692 | A1 | 11/2011 |
| WO | 2015021119 | A1 | 2/2015 |
| WO | 2015142482 | A1 | 9/2015 |
| WO | 2017105747 | A1 | 6/2017 |

OTHER PUBLICATIONS

Sannigrahi, Biswajit, et al., Copolymerization of Methyl Methacrylate with Lauryl Methacrylate Using Group Transfer Polymerization, J Polym Sci A: Polym Chem, Dec. 17, 1996, vol. 35, pp. 1999-2007, John Wiley & Sons, Inc., Pune, India.

Pitsikalis, Marinos, et al., Block Copolymers of Styrene and Stearyl Methacrylate. Synthesis and Micellization Properties in Selective Solvents, Macromolecules, Jul. 6, 2000, vol. 33, pp. 5460-5469, American Chemical Society, Web.

* cited by examiner

LUBRICATING COMPOSITION FOR AND METHOD OF LUBRICATING AN INTERNAL COMBUSTION ENGINE

CROSS REFERENCE TO RELATED APPLICATION

This application claims priority from PCT Application Serial No. PCT/US2018/039414 filed on Jun. 26, 2018, which claims the benefit of U.S. Provisional Application No. 62/525,360 filed on Jun. 27, 2017; the entirety both is hereby incorporated by reference.

BACKGROUND OF THE INVENTION

Lubricating oils usually contain surface active additives (including antiwear agents, dispersants, or detergents) to protect internal combustion engines from corrosion, wear, soot deposits and acid build up. Occasionally, while such surface active additives provide certain protections, they can also have unintended negative effects on engine component wear (in both iron and aluminum based components), bearing corrosion and/or fuel economy. A common antiwear additive for engine lubricating oils is zinc dialkyldithiophosphate (ZDDP). It is believed that ZDDP antiwear additives protect the engine by forming a protective film on metal surfaces. ZDDP has been observed to have a detrimental impact on fuel efficiency in some cases. Consequently, engine lubricants may also contain a friction modifier to obviate the detrimental impact of ZDDP on fuel economy. However, friction modifiers and other additives may also increase lead corrosion.

In addition, there has been a commercial trend for reduction in emissions (typically reduction of NOx formation, SOx formation) and a reduction in sulfated ash in engine oil lubricants. Consequently, the amounts of metal-containing antiwear agents such as ZDDP, overbased detergents such as calcium or magnesium sulfonates and phenates are being reduced. In addition, there is increasing interest in lubricating compositions that contain ashless additives that provide friction, antiwear, or antioxidant performance at least as good as, or even better than, the metal containing additives discussed above.

The majority of engine lubricating oils that are sold worldwide have relatively high viscosities (e.g., SAE Viscosity Grades of 10W-30, 10W-40, 15W-40, etc.). These high viscosity oils are very useful for many applications. However, in order to improve fuel economy, it would be advantageous to employ lubricating oil compositions with lower viscosities (e.g., SAE Viscosity Grades of 5W-30, 5W-20, OW-20, etc.). The problem with such low viscosity oils, however, is that they often do not exhibit sufficient antiwear properties to be deemed to be acceptable by industry standard tests for most engine lubricating oil uses.

For internal combustion engines designed having an end-pivot finger follower valve train with a lash adjuster, few studies have been reported regarding attempting to improve lubricant performance by reducing wear. As a result, Peugeot have introduced a test method entitled DW10 Lash Adjuster Test, run at APL testing laboratory (Automobil-Prüftechnik Landau GmbH) for engine having this design. To improve fuel efficiency, low viscosity lubricating oil compositions that can achieve good results on this test would be beneficial.

Thus, there is a need to provide a lubricating composition that is capable of providing desirable antiwear performance as well as enhanced fuel economy.

SUMMARY OF THE INVENTION

As used herein reference to the amounts of additives present in the lubricating composition disclosed herein are quoted on an oil free basis, i.e., amount of actives, unless otherwise indicated.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the basic and novel characteristics of the composition or method under consideration.

The invention relates to a lubricating composition comprising a base oil, a functionalized ethylene-α-olefin copolymer, and a poly(meth)acrylate copolymer. In some embodiments, the base oil is a low viscosity base oil and the lubricating composition maintains good high temperature, high shear dynamic viscosity while unexpectedly also providing good results on DW10 Lash Adjuster Test.

In one embodiment, the lubricating composition of the present invention comprises (a) a base oil, wherein the kinematic viscosity of the base oil measured at 100° C. is 2.4 $m^2$ to 4.6 $m^2/s$, (b) 0.05 weight percent to 5 weight percent of a functionalized ethylene-alpha olefin copolymer, (c) 0.3 weight percent to 5 weight percent of a poly(meth)acrylate polymer, and (d) 0.05 weight percent to 5 weight percent of a metal-free anti-wear agent. The lubricating composition has a dynamic viscosity measured according to ASTM D4683 at 150° C. of 1.4 mPas to 2.8 mPas.

Each component is described in detail in the detailed description of the invention below and may be used in various combinations that are all within the scope of the invention.

DETAILED DESCRIPTION OF THE INVENTION

The present invention provides a lubricating composition and a method for lubricating an internal combustion engine as disclosed herein.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056] (a similar disclosure is provided in US Patent Application 2010/197536, see [0072] to [0073]). A more detailed description of natural and synthetic lubricating oils is described in paragraphs [0058] to [0059] respectively of WO2008/147704 (a similar disclosure is provided in US Patent Application 2010/197536, see [0075] to [0076]). Synthetic oils may also be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E-API Base Oil Interchangeability Guidelines for Passenger Car Motor Oils and Diesel Engine Oils", section 1.3 Sub-heading 1.3. "Base Stock Categories". The API Guidelines are also summarised in U.S. Pat. No. 7,285,516 (see column 11, line 64 to column 12, line 10).

In one embodiment the oil of lubricating viscosity may be an API Group I to IV mineral oil, an ester or a synthetic oil, or mixtures thereof. In one embodiment the oil of lubricating viscosity may be an API Group II, Group III, Group IV mineral oil, an ester or a synthetic oil, or mixtures thereof.

The amount of the oil of lubricating viscosity present is typically the balance remaining after subtracting from 100 wt % the sum of the amount of the additives of the invention and the other performance additives.

The lubricating composition may be in the form of a concentrate and/or a fully formulated lubricant. If the lubricating composition of the invention (comprising the additives disclosed herein) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight. Typically the lubricating composition of the invention comprises at least 50 wt %, or at least 60 wt %, or at least 70 wt %, or at least 80 wt % of an oil of lubricating viscosity.

In the present invention, the lubricating composition comprises a base oil having a kinematic viscosity measured at 100° C. of 2.0 $m^2/s$ to 5.0 $m^2/s$, for example, 2.4 $m^2/s$ to 4.6 $m^2/s$.

Functionalized Ethylene-α-Olefin Copolymer

The lubricating composition of the invention contains a functionalized olefin copolymer. In one useful embodiment, the functionalized olefin copolymer is a functionalized ethylene-α-olefin copolymer. As used herein, the term "functionalized" means that the olefin polymer has been modified by the addition of a polar moiety. The olefin polymer and process for addition of the polar moieties is described in more detail below.

The olefin polymer may be derived from isobutylene or isoprene. In one useful embodiment, the olefin polymer is prepared from ethylene and a higher olefin within the range of C3-C10 alpha-mono-olefins, for example, the olefin polymer may be prepared from ethylene and propylene.

In one embodiment, the olefin polymer may be a polymer of 15 to 80 mole percent of ethylene, for example, 30 mol percent to 70 mol percent ethylene and from and from 20 to 85 mole percent of C3 to C10 mono-olefins, such as propylene, for example, 30 to 70 mol percent propylene or higher mono-olefins. Terpolymer variations of the olefin copolymer may also be used and may contain up to 15 mol percent of a non-conjugated diene or triene. Non-conjugated dienes or trienes may have 5 to about 14 carbon atoms. The non-conjugated diene or triene monomers may be characterized by the presence of a vinyl group in the structure and can include cyclic and bicyclic compounds. Representative dienes include 1,4-hexadiene, 1,4-cyclohexadiene, dicyclopentadiene, 5-ethyldiene-2-norbornene, 5-methylene-2-norbornene, 1,5-heptadiene, and 1,6-octadiene.

In one embodiment, the olefin copolymer may be a copolymer of ethylene, propylene, and butylene. The polymer may be prepared by polymerizing a mixture of monomers comprising ethylene, propylene and butylene. Such polymers may be referred to as copolymers or terpolymers. In one embodiment of the invention, a useful terpolymer may comprise from about 5 mol % to about 20 mol %, or from about 5 mol % to about 10 mol % structural units derived from ethylene; from about 60 mol % to about 90 mol %, or from about 60 mol % to about 75 mol structural units derived from propylene; and from about 5 mol % to about 30 mol %, or from about 15 mol % to about 30 mol % structural units derived from butylene. The butylene may comprise any isomers or mixtures thereof, such as n-butylene, iso-butylene, or a mixture thereof. The butylene may comprise butene-1. Commercial sources of butylene may comprise butene-1 as well as butene-2 and butadiene. In one embodiment, the butylene may comprise a mixture of butene-1 and isobutylene wherein the weight ratio of butene-1 to isobutylene is about 1:0.1 or less. In another embodiment, the butylene may comprise butene-1 and be free of or essentially free of isobutylene.

In another exemplary embodiment, the olefin copolymer may be a copolymer of ethylene and butylene, which may be prepared by polymerizing a mixture of monomers comprising ethylene and butylene wherein the monomer composition is free of or substantially free of propylene monomers (i.e. contains less than 1 weight percent of intentionally added monomer). In this embodiment, the copolymer may comprise 30 to 50 mol percent structural units derived from butylene; and from about 50 mol percent to 70 mol percent structural units derived from ethylene. The butylene may comprise a mixture of butene-1 and isobutylene wherein the weight ratio of butene-1 to isobutylene is about 1:0.1 or less. The butylene may comprise butene-1 and be free of or essentially free of isobutylene.

The olefin polymers useful in the present invention, in particular, the ethylene-α-olefin copolymers have a number average molecular weight, determined by Gel Permeation Chromatography (GPC) using a polystyrene standard, ranging from 1000 to 500,000 Daltons, for example, 3000 to 300,000 Daltons, or even 3000 to 200,000 Daltons, or even 3000 to 120,000 Daltons, or 10,000 to 60,000 Daltons, or 20,000 to 50,000 Daltons.

The olefin polymers are functionalized by modifying the polymer by the addition of a polar moiety. In one useful embodiment, the functionalized copolymer is the reaction product of an olefin polymer grafted with an acylating agent. In one embodiment, the acylating agent may be an ethylenically unsaturated acylating agent. Useful acylating agents are typically α,β unsaturated compounds having at least one ethylenic bond (prior to reaction) and at least one, for example two, carboxylic acid (or its anhydride) groups or a polar group which is convertible into said carboxyl groups by oxidation or hydrolysis. The acylating agent grafts onto the olefin polymer to give two carboxylic acid functionalities. Examples of useful acylating agents include maleic anhydride, chlormaleic anhydride, itaconic anhydride, or the reactive equivalents thereof, for example, the corresponding dicarboxylic acids, such as maleic acid, fumaric acid, cinnamic acid, (meth)acrylic acid, the esters of these compounds and the acid chlorides of these compounds.

In one embodiment, the functionalized ethylene-α-olefin copolymer comprises an olefin copolymer grafted with the acyl group which is further functionalized with a hydrocarbyl amine, a hydrocarbyl alcohol group, amino- or hydroxy-terminated polyether compounds, and mixtures thereof.

Amine functional groups may be added to the olefin polymer by reacting the olefin copolymer (typically, an ethylene-α-olefin copolymer, such as an ethylene-propylene copolymer) with an acylating agent (typically maleic anhydride) and a hydrocarbyl amine having a primary or secondary amino group. In one embodiment, the hydrocarbyl amine may be selected from aromatic or heteroaromatic amines, aliphatic amines, and mixtures thereof.

In one embodiment, the hydrocarbyl amine component may comprise at least one aromatic amine containing at least one amino group capable of condensing with said acyl group to provide a pendant group and at least one additional group comprising at least one nitrogen, oxygen, or sulfur atom, wherein said aromatic amine is selected from the group consisting of (i) a nitro-substituted aniline, (ii) an amine comprising two aromatic moieties linked by a —C(O)NR— group, a —C(O)O— group, an —O— group, an —N═N— group, or an —$SO_2$— group where R is hydrogen or hydrocarbyl, one of said aromatic moieties bearing said condensable amino group, (iii) an aminoquinoline, (iv) an aminobenzimidazole, (v) an N,N-dialkylphenylenediamine, (vi), an aminodiphenylamine (also N,N-phenyl di amine), and (vii) a ring-substituted benzyl amine.

Aromatic amines useful for providing the polar moiety of the functionalized ethylene-α-olefin copolymer may also include those which can be represented by the general structure $NH_2$—Ar or T-NH—Ar, where T may be alkyl or aromatic, Ar is an aromatic group, including nitrogen-containing or amino-substituted aromatic groups and Ar groups including any of the following structures:

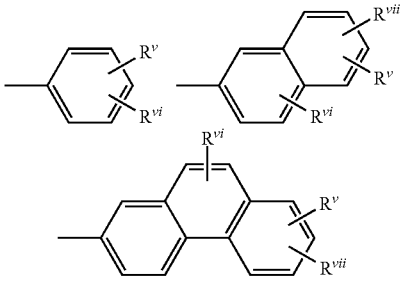

as well as multiple non-condensed or linked aromatic rings. In these and related structures, $R^v$, $R^{vi}$, and $R^{vii}$ can be independently, among other groups disclosed herein, —H, —$C_{1-18}$ alkyl groups, nitro groups, —NH—Ar, —N═N—Ar, —NH—CO—Ar, —OOC—Ar, —OOC—$C_{1-18}$ alkyl, —COO—$C_{1-18}$ alkyl, —OH, —O—$(CH_2CH_2$—$O)_nC_{1-18}$ alkyl groups, and —O—$(CH_2CH_2O)_n$Ar (where n is 0 to 10).

Useful aromatic amines may also include those amines wherein a carbon atom of the aromatic ring structure is attached directly to the amino nitrogen. The amines may be monoamines or polyamines. The aromatic ring will typically be a mononuclear aromatic ring (i.e., one derived from benzene) but can include fused aromatic rings, especially those derived from naphthalene. Examples of aromatic amines include aniline, N-alkylanilines such as N-methylaniline and N-butylaniline, di-(para-methylphenyl)amine, 4-aminodiphenyl amine, N,N-dimethylphenylenediamine, naphthylamine, 4-(4-nitrophenylazo)aniline (disperse orange 3), sulphamethazine, 4-phenoxyaniline, 3-nitroaniline, 4-aminoacetanilide (N-(4-aminophenyl)acetamide)), 4-amino-2-hydroxy-benzoic acid phenyl ester (phenyl amino salicylate), N-(4-amino-phenyl)-benzamide, various benzylamines such as 2,5-dimethoxybenzylamine, 4-phenylazoaniline, and substituted versions of these. Other examples include para-ethoxyaniline, para-dodecylaniline, cyclohexyl-substituted naphthylamine, and thienyl-substituted aniline. Examples of other suitable aromatic amines include amino-substituted aromatic compounds and amines in which the amine nitrogen is a part of an aromatic ring, such as 3-aminoquinoline, 5-aminoquinoline, and 8-aminoquinoline. Also included are aromatic amines such as 2-aminobenzimidazole, which contains one secondary amino group attached directly to the aromatic ring and a primary amino group attached to the imidazole ring. Other amines include N-(4-anilinophenyl)-3-aminobutanamide or 3-amino propyl imidazole. Yet other amines include 2,5-dimethoxybenzylamine.

Additional aromatic amines and related compounds that may be useful for the functional group are disclosed in U.S. Pat. Nos. 6,107,257 and 6,107,258; some of these include aminocarbazoles, benzoimidazoles, aminoindoles, aminopyrroles, amino-indazolinones, aminoperimidines, mercaptotriazoles, aminophenothiazines, aminopyridines, aminopyrazines, aminopyrimidines, pyridines, pyrazines, pyrimidines, aminothiadiazoles, aminothiothiadiazoles, and aminobenzotriaozles. Other suitable amines include 3-amino-N-(4-anilinophenyl)-N-isopropyl butanamide, and N-(4-anilinophenyl)-3-{(3-aminopropyl)-(cocoalkyl) amino} butanamide. Other aromatic amines which can be used include various aromatic amine dye intermediates containing multiple aromatic rings linked by, for example, amide structures. Examples include materials of the general structure:

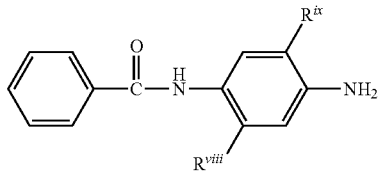

and isomeric variations thereof, where $R^{viii}$ and $R^{ix}$ are independently alkyl or alkoxy groups such as methyl, methoxy, or ethoxy. In one instance, $R^{viii}$ and $R^{ix}$ are both —$OCH_3$ and the material is known as Fast Blue RR [CAS #6268-05-9].

In another instance, $R^{ix}$ is —$OCH_3$ and $R^{viii}$ is —$CH_3$, and the material is known as Fast Violet B [CAS #99-21-8]. When both $R^{viii}$ and $R^{ix}$ are ethoxy, the material is Fast Blue BB [CAS #120-00-3]. U.S. Pat. No. 5,744,429 discloses other aromatic amine compounds, particularly aminoalkylphenothiazines. N-aromatic substituted acid amide compounds, such as those disclosed in U.S. Patent Application 2003/0030033 A1, may also be used for the purposes of this invention. Suitable aromatic amines include those in which the amine nitrogen is a substituent on an aromatic carboxyclic compound, that is, the nitrogen is not $sp^2$ hybridized within an aromatic ring.

In another embodiment, a useful aromatic amine may also comprise an amine formed by reacting an aldehyde with 4-aminodiphenylamine. The resultant amine may be described as an alkylene coupled amine having at least 4 aromatic groups, at least one —$NH_2$ functional group, and at least 2 secondary or tertiary amino groups. The aldehyde may be aliphatic, alicyclic or aromatic. The aliphatic aldehyde may be linear or branched. Examples of a suitable aromatic aldehyde include benzaldehyde or o-vanillin. Examples of an aliphatic aldehyde include formaldehyde (or a reactive equivalent thereof such as formalin or paraformaldehyde), ethanal or propanal. Typically the aldehyde may be formaldehyde or benzaldehyde. Alternatively, this aromatic amine may also be prepared by the methodology described in Berichte der Deutschen Chemischen Gesellschaft (1910), 43, 728-39.

The aromatic amine formed by coupling an aldehyde and 4-aminodiphenylamine is described European Patent application EP 2 401 348 A in and may also be represented by the formula:

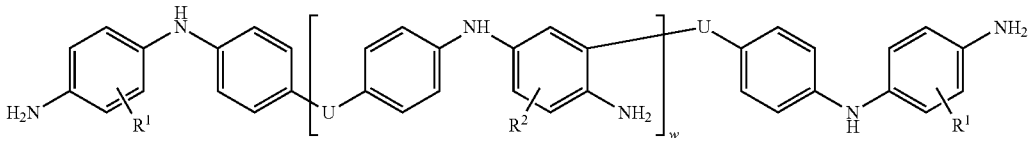

wherein each variable $R^1$ may be hydrogen or a $C_{1-5}$ alkyl group (typically hydrogen);

$R^2$ may be hydrogen or a $C_{1-5}$ alkyl group (typically hydrogen);

U may be an aliphatic, alicyclic or aromatic group, with the proviso that when U is aliphatic, the aliphatic group may be linear or branched alkylene group containing 1 to 5, or 1 to 2 carbon atoms; and w may be 0 to 9 or 0 to 3 or 0 to 1 (typically 0).

In one embodiment, the aromatic amine includes 4-aminodiphenylamine, aldehyde (typically formaldehyde) coupled 4-aminodiphenylamine, nitro-aniline (3-nitro-aniline), disperse orange-3 (DO3), or mixtures thereof.

In one embodiment, the hydrocarbyl amine component may comprise at least one aliphatic amine containing at least one amino group capable of condensing with said acyl group to provide a pendant group and at least one additional group comprising at least one nitrogen, oxygen, or sulfur atom. Suitable aliphatic amines include polyethylene polyamines (such as tetraethylene pentamine (TEPA), triethylene tetra amine (TETA), pentaethylene hexamine (PEHA), and polyamine bottoms), N,N-dimethylaminopropylamine (DMAPA), N-(aminopropyl)morpholine, N,N-diIsostearylaminopropylamine, ethanolamine, and combinations thereof.

In another one embodiment, the polar moiety added to the functionalized ethylene-α-olefin copolymer may be derived from a hydrocarbyl alcohol group, containing at least one hydroxy group capable of condensing with said acyl group to provide a pendant group and at least one additional group comprising at least one nitrogen, oxygen, or sulfur atom. The alcohol functional groups may be added to the olefin polymer by reacting the olefin copolymer with an acylating agent (typically maleic anhydride) and a hydrocarbyl alcohol. Suitable hydrocarbyl alcohols include trimethylol propane (TMP), pentaerythritol, dimethylaminopropanol, 4-(2-hydroxyethyl)morpholine and isomers, 4-(3-hydroxypropyl) morpholine and isomers, In another one embodiment, the polar moiety added to the functionalized ethylene-α-olefin copolymer may be amine-terminated polyether compounds, hydroxy-terminated polyether compounds, and mixtures thereof. The hydroxy terminated or amine terminated polyether may be selected from the group comprising polyethylene glycols, polypropylene glycols, mixtures of one or more amine terminated polyether compounds containing units derived from ethylene oxides, propylene oxides, butylene oxides or some combination thereof, or some combination thereof. Suitable polyether compounds include Synalox® line of polyalkylene glycol compounds, the UCON™ OSP line of polyether compounds available from Dow Chemical, Jeffamine® line of polyether amines available from Huntsman.

In one embodiment, the ethylene-α-olefin copolymer is grafted with a polar moiety, comprising an acyl group, wherein the acyl group is provided by an acylating agent, such as maleic anhydride. In the present invention, the ethylene-α-olefin copolymer is reacted with 1% to 3.5% by weight, for example, 1.5% to 3.25% by weight of an acylating agent based on the total weight of the ethylene-α-olefin copolymer plus acylating agent. The so acylated ethylene-α-olefin copolymer may be further reacted with a hydrocarbyl amine. The amount of the hydrocarbyl amine may be an equivalent mole percent to the mole percent of the acyl groups or an amount to fulfill the stoichiometric needs to fully react with all of the acyl groups. In one embodiment, the functionalized ethylene-α-olefin copolymers have a weight average molecular weight, measured by gel permeation chromatography calibrated to polystyrene standards, of 50,000 Daltons up to 200,000 Daltons, for example, 100,000 Daltons up to 175,000 Daltons.

The formation of functionalized ethylene-α-olefin copolymer is well known in the art, for instance those described in U.S. Pat. No. 7,790,661 column 2, line 48 to column 10, line 38. Additional detailed descriptions of similar functionalized ethylene-α-olefin copolymers are found in International Publication WO2006/015130 or U.S. Pat. Nos. 4,863,623; 6,107,257; 6,107,258; 6,117,825; and 7,790,661. In one embodiment the functionalized ethylene-α-olefin copolymer may include those described in U.S. Pat. No. 4,863,623 (see column 2, line 15 to column 3, line 52) or in International Publication WO2006/015130 (see page 2, paragraph [0008] and preparative examples are described paragraphs [0065] to [0073]).

The lubricating compositions of the present invention comprise 0.05 wt % to 3 wt %, or 0.08 wt % to 1.8 wt %, or 0.1 to 1.2 wt % of the functionalized ethylene-α-olefin copolymer as described herein.

Polymethacrylate Polymers

The lubricating composition of the present invention also comprises a poly(meth)acrylate polymer. As used herein, the term "(meth)acrylate" means either methacrylate or acrylate, as will be readily understood.

In one embodiment, the poly(meth)acrylate polymer is prepared from a monomer mixture comprising (meth)acrylate monomers having alkyl groups of varying length. The (meth)acrylate monomers may contain alkyl groups that are straight chain or branched chain groups or aromatic groups. The alkyl groups may contain 1 to 24 carbon atoms, for example 1 to 20 carbon atoms.

The poly(meth)acrylate polymers described herein are formed from monomers derived from saturated alcohols, such as methyl (meth)acrylate, ethyl (meth)acrylate, propyl (meth)acrylate, butyl (meth)acrylate, 2-methylpentyl (meth) acrylate, 2-propylheptyl (meth)acrylate, 2-butyloctyl (meth) acrylate, 2-ethylhexyl (meth)acrylate, octyl (meth)acrylate, nonyl (meth)acrylate, isooctyl (meth)acrylate, isononyl (meth)acrylate, 2-tert-butylheptyl (meth)acrylate, 3-isopropylheptyl (meth)acrylate, decyl (meth)acrylate, undecyl (meth)acrylate, 5-methylundecyl (meth)acrylate, dodecyl (meth)acrylate, 2-methyldodecyl (meth)acrylate, tridecyl (meth)acrylate, 5-methyltridecyl (meth)acrylate, tetradecyl (meth)acrylate, pentadecyl (meth)acrylate, hexadecyl (meth)acrylate, 2-methylhexadecyl (meth)acrylate, heptadecyl (meth)acrylate, 5-isopropylhepta-decyl (meth)acrylate, 4-tert-butyloctadecyl (meth)acrylate, 5-ethyloctadecyl (meth)acrylate, 3-isopropyl octadecyl-(meth)acrylate, octadecyl (meth)acrylate, nonadecyl (meth)acrylate, eicosyl (meth)acrylate, (meth)acrylates derived from unsaturated alcohols, such as oleyl (meth)acrylate; and cycloalkyl (meth)acrylates, such as 3-vinyl-2-butylcyclohexyl (meth) acrylate or bornyl (meth)acrylate.

Other examples of monomers include alkyl (meth)acrylates with long-chain alcohol-derived groups which may be obtained, for example, by reaction of a (meth)acrylic acid (by direct esterification) or methyl (meth)acrylate (by transesterification) with long-chain fatty alcohols, in which reaction a mixture of esters such as (meth)acrylate with alcohol groups of various chain lengths is generally obtained. These fatty alcohols include Nafol® 1620, Alfol® 10, Alfol® 810, Alfol® 12, Alfol® 1012EE, Alfol® 1014CDC, Alfol® 1214, Alfol® 1214GC, Alfol® 1214HA, Alfol® 1216, and Lial® 125 of Sasol; Neodol® 91, Neodol® 23, Neodol® 25, Neodol® 45 and Neodol® 135 of Shell AG; C13-C15 Alcohol, Isotridecanol, Hydrenol® and Lorol® of BASF; Kalcol® 2465, Kalcol® 2470, Kalcol® 8655 of Kao Corporation, as well as Econol® 80, Econol® 24, Econol® 26, Econol® 28, and Econol® 68 of Ecogreen Oleochemicals. Further examples of monomers include alkyl (methacrylates) with branched chain alcohol-derived groups which may be obtained, for example, by reaction of a (meth)acrylic acid (by direct esterification) or methyl (meth)acrylate (by transesterification) with Guerbet alcohols. Examples of Guerbet alcohols include 2-butyloctanol, 2-butyldecanol, 2-hexyloctanol, 2-hexyldecanol, 2-octyldecanol, 2-hexyldodecanol, 2-octyldodecanol, 2-decyltetradecanol, 2-dodecylhexadecanol, and 2-tetradecyloctadecanol.

Aromatic monomers may include, for example, benzyl methacrylate. In another embodiment, the aromatic monomers may be selected from phenyl methacrylate, phenylpropyl methacrylate or styrene. It is contemplated that other oil insoluble (meth)acrylate monomers that are polymerizable in oil may also be used. Mixtures of these and other oil insoluble monomers may also be used in the present invention.

In one embodiment, the poly(meth)acrylate polymer comprises a dispersant monomer; dispersant monomers include those monomers which may copolymerize with (meth)acrylate monomers and contain one or more heteroatoms in addition to the carbonyl group of the (meth)acrylate. The dispersant monomer may contain a nitrogen-containing group, an oxygen-containing group, or mixtures thereof.

The oxygen-containing compound may include hydroxyalkyl(meth)acrylates such as 3-hydroxypropyl(meth)acrylate, 3,4-dihydroxybutyl(meth)acrylate, 2-hydroxyethyl (meth)acrylate, 2-hydroxypropyl(meth)acrylate, 2,5-dimethyl-1,6-hexanediol(meth)acrylate, 1,10-decanediol (meth)acrylate, carbonyl-containing (meth)acrylates such as 2-carboxyethyl(meth)acrylate, carboxymethyl(meth)acrylate, oxazolidinylethyl(meth)acrylate, N-(methacryloyloxy) formamide, acetonyl(meth)acrylate, N-methacryloylmorpholine, N-methacryloyl-2-pyrrolidinone, N-(2-methacryloyl-oxyethyl)-2-pyrrolidinone, N-(3-methacryloyl oxypropyl)-2-pyrrolidinone, N-(2-methacryloyloxypentadecyl)-2-pyrrolidinone, N-(3-methacryloyloxy-heptadecyl)-2-pyrrolidinone; glycol di(meth)acrylates such as 1,4-butanediol(meth)acrylate, 2-butoxyethyl(meth)acrylate, 2-ethoxyethoxymethyl(meth)acrylate, 2-ethoxyethyl(meth) acrylate, or mixtures thereof.

The nitrogen-containing compound may be a (meth) acrylamide or a nitrogen containing (meth)acrylate monomer. Examples of a suitable nitrogen-containing compound include N,N-dimethylacrylamide, N-vinyl carbonamides such as N-vinyl-formamide, vinyl pyridine, N-vinylacetoamide, N-vinyl propionamides, N-vinyl hydroxy-acetoamide, N-vinyl imidazole, N-vinyl pyrrolidinone, N-vinyl caprolactam, N-vinyl furan, vinyl oxazole, N,N-dimethylaminoethyl(meth)acrylate, N,N-dimethylaminopropyl (meth)acrylate, N,N-diethylaminoethyl(meth)acrylate, 2-diisopropylaminoethyl(meth)acrylate, 2-t-butylaminoethyl (meth)acrylate, N-2-dimethylaminoethyl(meth)acryl amide, N-3-dimethylaminopropyl(meth)acrylamide N,N-dimethylaminobutyl(meth)acryl amide, N-2-diethylaminoethyl (meth)acrylamide or mixtures thereof.

Dispersant monomers may be present in an amount up to 5 mol percent of the monomer composition of the (meth) acrylate polymer. In one embodiment, a dispersant monomer is present in the poly(meth)acrylate polymer in an amount 0 to 5 mol percent, 0.5 to 4 mol percent, or 0.8 to 3 mol percent of the polymer composition. In one embodiment, the poly (meth)acrylate is free of or substantially free of dispersant monomers.

In one embodiment, the poly(meth)acrylate comprises a block copolymer or tapered block copolymer. Block copolymers are formed from a monomer mixture comprising one or more (meth)acrylate monomers, wherein, for example, a first (meth)acrylate monomer forms a discrete block of the polymer joined to a second discrete block of the polymer formed from a second (meth)acrylate monomer. While block copolymers have substantially discrete blocks formed from the monomers in the monomer mixture, a tapered block copolymer may be composed of, at one end, a relatively pure first monomer and, at the other end, a relatively pure second monomer. The middle of the tapered block copolymer is more of a gradient composition of the two monomers.

In one embodiment of the invention, the poly(meth) acrylate polymer (P) is a block or tapered block copolymer that comprises at least one polymer block ($B_1$) that is insoluble or substantially insoluble in the base oil and a second polymer block ($B_2$) that is soluble or substantially soluble in the base oil. The Hildebrand solubility parameter can be used as a guide to determine the solubility of polymers in a specific medium. This parameter is described in detail in the *Polymer Handbook*, Fourth Edition, ed. J. Brandrup, E. J. Immergut, and E. A. Grulke, John Wiley & Sons, New York, 1999 in the chapter titled "Solubility Parameter Values." Compatibility of segments of a block or tapered block copolymer can be estimated using the Hildebrand solubility parameters. For example, the oil-soluble block typically will have a solubility parameter of 14-18 $(J/m^3)^{1/2}$ while an oil insoluble block will have a solubility parameter greater than 18 $(J/m^3)^{1/2}$ or even in some embodiments greater than 19 $(J/m^3)^{1/2}$. Generally, the solubility parameter is measured or calculated for homopolymers made from particular (meth)acrylate monomers, which allows the selection of monomers for preparing the poly (meth)acrylate polymer as described above.

The block copolymer useful in the present invention comprises two or more blocks. A copolymer with two blocks may be described as a di-block AB type copolymer. A block copolymer that has three blocks (i.e. a tri-block copolymer), may be described as an ABA type copolymer or an ABC type copolymer. In one embodiment, block copolymers with three of more blocks may comprise at least one polymer block that is insoluble or substantially insoluble in the base oil. In block copolymers with three or more blocks with at least one insoluble block, the insoluble block may be an external or terminal block, i.e. a polymer block containing one polymer end which may be functionalized with an initiator fragment or chain transfer moiety.

In one embodiment, the poly(meth)acrylate polymers may have an architecture selected from linear, branched, hyperbranched, cross-linked, star (also referred to as "radial"), or combinations thereof. Star or radial refers to multi-armed polymers. Such polymers include (meth)acrylate-containing polymers comprising 3 or more arms or branches, which, in some embodiments, contain at least about 20, or at least 50 or 100 or 200 or 350 or 500 or 1000 carbon atoms. The arms are generally attached to a multivalent organic moiety which acts as a "core" or "coupling agent." The multi-armed polymer may be referred to as a radial or star polymer, or even a "comb" polymer, or a polymer otherwise having multiple arms or branches as described herein.

Star polymers may be prepared by a number of known polymerization methods, including atom transfer radical polymerization (ATRP), reversible addition-fragmentation chain transfer (RAFT) polymerization, nitroxide mediated polymerization (NMP), or anionic polymerization. A detailed discussion of ATRP is given in Chapter 11, pages 523 to 628 of the *Handbook of Radical Polymerization*, Edited by Krzysztof Matyjaszewski and Thomas P. Davis, John Wiley and Sons, Inc., 2002 (hereinafter referred to as "Matyjaszewski"). See in particular reaction scheme 11.1 on page 524, 11.4 on page 556, 11.7 on page 571, 11.8 on page 572, and 11.9 on page 575.

RAFT polymerization may be employed when the core portion of the polymer contains a functional group of formula (I) above wherein Y is represented by —S—C(═S)—$R^5$ where $R^5$ may be an alkyl radical containing 1 to 20 carbon atoms. The Y functionality may be derived from or be a portion of a chain transfer agent. In certain embodiments the core portion comprises a functional group (often from a chain transfer agent) derived from a compound comprising a thiocarbonyl thio group and a free radical leaving groups, such as those disclosed in paragraph 0146 of U.S. Application 2007/0244018.

Examples of RAFT chain transfer agents include benzyl 1-(2-pyrrolidinone)carbodithioate, benzyl (1,2-benzenedicarboximido)carbodithioate, 2-cyanoprop-2-yl 1-pyrrolecarbodithioate, 2-cyanobut-2-yl 1-pyrrolecarbodithioate, benzyl 1-imidazolecarbodithioate, N,N-dimethyl-S-(2-cyanoprop-2-yl)dithiocarbamate, N,N-diethyl-S-benzyl dithiocarbamate, cyanomethyl 1-(2-pyrrolidone)carbodithoate, cumyl dithiobenzoate, N,N-diethyl S-(2-ethoxy-carbonyl-prop-2-yl)dithiocarbamate, O-ethyl-S-(1-phenylethyl)xanthtate, O-ethyl-S-(2-(ethoxycarbonyl)prop-2-yl)xanthate, O-ethyl-S-(2-cyanoprop-2-yl)xanthate, O-ethyl-S-(2-cyanoprop-2-yl)xanthate, O-ethyl-S-cyanomethyl xanthate, 0-phenyl-S-benzyl xanthate, 0-pentafluorophenyl-S-benzyl xanthate, 3-benzylthio-5,5-dimethylcyclohex-2-ene-1-thione or benzyl 3,3-di(benzylthio)prop-2-enedithioate, S,S'-bis-(α,α'-disubstituted-α"-acetic acid)-trithiocarbonate, S,S'-bis-(α,α'-disubstituted-α"-acetic acid)-trithiocarbonate or S-alkyl-S'-(-(α,α'-disubstituted-α"-acetic acid)-trithiocarbonates, dithiobenzoic acid, 4-chlorodithiobenzoic acid, benzyl dithiobenzoate, 1-phenylethyl dithiobenzoate, 2-phenylprop-2-yl dithiobenzoate, 1-acetoxyethyl dithiobenzoate, hexakis(thiobenzoylthiomethyl)-benzene, 1,4-bis(thiobenzoylthiomethyl)benzene, 1,2,4,5-tetrakis(thiobenzoylthiomethyl)benzene, 1,4-bis-(2-(thiobenzoylthio)prop-2-yl)benzene, 1-(4-methoxyphenyl)ethyl dithiobenzoate, benzyl dithioacetate, ethoxycarbonylmethyl dithioacetate, 2-(ethoxycarbonyl)prop-2-yl dithiobenzoate, 2,4,4-trimethylpent-2-yl dithiobenzoate, 2-(4-chlorophenyl)prop-2-yl dithiobenzoate, 3-vinylbenzyl dithiobenzoate, 4-vinylbenzyl dithiobenzoate, S-benzyl diethoxyphosphinyldithioformate, tert-butyl trithioperbenzoate, 2-phenylprop-2-yl 4-chlorodithiobenzoate, 2-phenylprop-2-yl 1-dithionaphthalate, 4-cyanopentanoic acid dithiobenzoate, dibenzyl tetrathioterephthalate, dibenzyl trithiocarbonate, carboxymethyl dithiobenzoate or poly(ethylene oxide) with dithiobenzoate end group or mixtures thereof. RAFT polymerization is also described in greater detail in Chapter 12, pages 629 to 690 of Matyjaszewski, especially pages 664 to 665.

For example, a star polymer, may comprise (i) a core portion comprising a polyvalent (meth) acrylic monomer, oligomer or polymer thereof or a polyvalent divinyl non-acrylic monomer, oligomer or polymer thereof; and (ii) at least three arms of polymerized alkyl (meth)acrylate esters. In one embodiment, the arms of the star polymer may be random copolymers or, more preferably for this invention, block or tapered block copolymers. The core portion may comprise a functional group of formula (Ia):

(I[a])

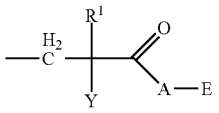

wherein E is independently another part of the core, a polymeric arm or to a monomeric species, or another structural unit as defined by formula (Ia); $R^1$ is hydrogen or a linear or branched alkyl group containing 1 to 5 carbon atoms; A is nitrogen or oxygen; and Y is a free radical leaving group selected from the group consisting of one or more atoms or groups of atoms which may be transferred by a radical mechanism under the polymerization conditions, a halogen, a nitroxide group or a dithio ester group. Analogous to structure (Iz), the bond shown at the left of structure (Ia) may typically be attached to a Z group, where Z is a polymeric group such as a crosslinked polymeric group.

Examples of the polyvalent unsaturated (meth)acrylic monomer useful for forming the polymer core include ethylene glycol diacrylate, ethylene glycol di(meth)acrylate, diethylene glycol diacrylate, diethylene glycol di(meth) acrylate, glycerol diacrylate, glycerol triacrylate, mannitol hexaacrylate, 4-cyclohexanediol diacrylate, 1,4-benzenediol di(meth)acrylate, neopentylglycol diacrylate, 1,3-propanediol diacrylate, 1,5-pentanediol di(meth)acrylate, bis-acrylates and bis-(meth)acrylates of polyethylene glycols of molecular weight 200-4000, polycaprolactonediol diacrylate, 1,1,1-trimethylolpropane diacrylate, 1,1,1-trimethylolpropane triacrylate, pentaerythritol diacrylate, pentaerythritol triacrylate, pentaerythritol tetraacrylate, triethylene glycol diacrylate, triethylene glycol di(meth)acrylate, 1,1,1-trimethylolpropane tri(meth)acrylate, hexamethylenediol diacrylate or hexamethylenediol di(meth)acrylate, vinyl (meth)acrylate, allyl (meth)acrylate or an alkylene bis-(meth)acrylamide.

Examples of the polyvalent or divalent unsaturated non-acrylic monomer useful for forming the polymer core include divinylbenzene, ethylene glycol divinyl ether, diethylene glycol divinyl ether, triethylene glycol divinyl ether, poly(ethylene glycol) divinyl ether, butanediol divinyl ether, bicyclo[2.2.1]hepta-2,5-diene.

The amount of core portion or coupling agent may be an amount suitable to provide coupling of previously prepared polymeric arms onto the core in monomeric, oligomeric, or polymeric form, to provide a star polymer. As described above, suitable amounts may be determined readily by the person skilled in the art with minimal experimentation, even though several variables may be involved. For example, if an excessive amount of coupling agent is employed, or if excessive unreacted monomer from the formation of the polymeric arms remains in the system, crosslinking rather than star formation may occur. Typically the mole ratio of polymer arms to coupling agent may be 50:1 to 1.5:1 (or 1:1), or 30:1 to 2:1, or 10:1 to 3:1, or 7:1 to 4:1, or 4:1 to 1:1. In other embodiments the mole ratio of polymer arms to coupling agent may be 50:1 to 0.5:1, or 30:1 to 1:1, or 7:1 to 2:1. The desired ratio may also be adjusted to take into account the length of the arms, longer arms sometimes tolerating or requiring more coupling agent than shorter arms.

The arms of the star polymer may themselves be (meth) acrylate-containing polymer or oligomer moieties, comprising (meth)acrylic moieties condensed with alcohol moieties to provide alkyl groups. The arms of the star polymer as described herein may be block or tapered block copolymers as described above. In one embodiment the star polymer comprises at least 3 arms, in another embodiment at least 5 arms, in another embodiment at least 7 arms, in another embodiment at least 10 arms, for instance 12 to 100, 14 to 50, or 16 to 40 arms. In one embodiment the star polymer may have 120 arms or less, in another embodiment 80 arms or less, in another embodiment 60 arms or less. In certain embodiments there may be 3 to 20, 5 to 20, or 6 to 15, or 7 to 8 arms per star. Such multi-armed polymers and their preparation are described in greater detail in WO2015/142482, Sep. 24, 2015, see in particular paragraphs 0017 through 0064.

Particularly useful poly(meth)acrylate copolymers for this invention include block or tapered block poly(meth)acrylate polymers (P) which have a first block ($B_1$) that is substantially insoluble or insoluble in the base oil of the lubricating composition and a second block (B2) which is substantially soluble or soluble in the base oil of the lubricating composition. The first block may comprise one or more monomers that form polymers which are substantially insoluble in the base oil. For example, the first block ($B_1$) may comprise at least 50 mol %, for example, 50 mol % to 100 mol %, or further for example, 50 mol % to 98 mol %, of $C_1$ to $C_4$ alkyl (meth)acrylate-derived units (typically including methyl methacrylate). In one embodiment, block $B_1$ is derived from two or more of $C_1$, $C_2$, $C_3$, and $C_4$ alkyl (meth)acrylate derived units. In another embodiment, the first block comprises at least 50 mol %, for example 50 mol % to 100 mol % of an aromatic (meth)acrylate derived unit or styrene. For example, the aromatic monomers, include but are not limited to benzyl methacrylate, phenyl methacrylate, phenylpropyl methacrylate, or styrene. It is contemplated that mixtures of monomers may be used to form the insoluble block. In an embodiment, of the invention, the first block may comprise 50 mol % to 100 mol % of a mixture of $C_1$ to $C_4$ alkyl (meth)acrylate-derived units and aromatic (meth)acrylate monomers and/or styrene. In some embodiments, the first block is substantially free of styrene.

In one embodiment, the second block (B2) comprises at least 50 mol %, for example, 50 mol % to 100 mol %, further for example, 50 mol % to 98 mol %, of $C_8$ to $C_{32}$ alkyl (meth)acrylate derived units, for example $C_8$ to $C_{24}$. In some embodiments, the substantially soluble block ($B_2$) comprises $C_{10}$ to $C_{18}$ alkyl(meth)acrylate derived units, $C_{12}$ to $C_{18}$ alkyl(meth)acrylate derived units, or even $C_{12}$ to $C_{16}$ alkyl (meth)acrylate derived units. In one embodiment, block $B_2$ is derived from two or more of $C_8$, $C_9$, $C_{10}$, $C_{11}$, $C_{12}$, $C_{13}$, $C_{14}$, $C_{15}$, $C_{16}$, $C_{17}$, or $C_{18}$ alkyl (meth)acrylate derived units.

In one embodiment, the poly(meth)acrylate copolymer (P) comprises a first block ($B_1$) which contains at least 50 mol %, for example 50 mol % to 98 mol %, or even 50 mol % to 100 mol % methyl(meth)acrylate derived units and a second block ($B_2$) which contains at least 50 mol %, for example, 50 mol % to 99 mol %, or even 50 mol % to 100 mol % of a mixture of two or more of $C_{12}$, $C_{13}$, $C_{14}$, $C_{15}$, $C_{16}$, $C_{17}$, $C_{18}$ alkyl(meth)acrylate derived units. In one embodiment, the first block consists of methyl(meth)acrylate derived units and the second block consists of a mixture of two or more of $C_{12}$, $C_{13}$, $C_{14}$, $C_{15}$, $C_{16}$, $C_{17}$, $C_{18}$ alkyl(meth)acrylate derived units. In another embodiment, the poly(meth)acrylate copolymer (P) comprises a first block ($B_1$) which contains at least 50 mol %, for example 50 mol % to 98 mol %, or even 50 mol % to 100 mol % benzyl (meth)acrylate methyl derived units and a second block ($B_2$) which contains at least 50 mol %, for example, 50 mol % to 99 mol %, or even 50 mol % to 100 mol % of a mixture of two or more of $C_{12}$, $C_{13}$, $C_{14}$, $C_{15}$, $C_{16}$, $C_{17}$, $C_{18}$ alkyl(meth) acrylate derived units. In one embodiment, the first block consists of methyl(meth)acrylate derived units and the second block consists of a mixture of two or more of $C_{12}$, $C_{13}$, $C_{14}$, $C_{15}$, $C_{16}$, $C_{17}$, $C_{18}$ alkyl(meth)acrylate derived units.

In some embodiments, the poly(meth)acrylate polymers described herein, in particular the block co-polymers described herein may form self-assembled colloidally stable polymeric particles in oil. The particles may be in the form of aggregates, vesicles, rods, worms, or spheres. In one particularly useful embodiment, the particles are spheres. In one embodiment, the spheres may have a mean diameter measured by dynamic light scattering (DLS) of 10 to 300 nanometers, for example, 20 to 100 nanometers, or even 30 to 70 nanometers. The present invention may also include tri-block copolymers including the $B_1$ and $B_2$ blocks as described above, with the proviso that the third block of the polymer, when included, does not substantially alter the ability of the polymer to self-assemble as described herein. In some embodiments, the third block may be derived from polyvalent or divalent unsaturated monomers, which are suitable for crosslinking the copolymer chains. Such polyvalent or divalent unsaturated monomers, when present, can function to reinforce the self-assembled polymer particles.

In one embodiment, the block or tapered block copolymer may be a di-block copolymer, wherein the ratio of the two blocks may be 95:5 to 5:95 by mol, or 80:20 to 20:80 by mol, or 70:30 to 30:70 by mol.

In another embodiment, the poly(meth)acrylate copolymer is a star or radial copolymer having three or more arms. The arms of the star or radial copolymer comprise block copolymers as described above. In one embodiment, one or more arms of the star polymer are block copolymers as described above. For example, in one embodiment, the star polymer comprises three or more arms which comprise block or tapered block copolymers, having an inner block and an outer block. In this embodiment, the inner block ($B_1$) comprises at least 50 mol %, for example, 50 mol % to 100 mol %, or further for example, 50 mol % to 98 mol %, of $C_1$ to $C_4$ alkyl (meth)acrylate-derived units (typically including methyl methacrylate). In one embodiment, block $B_1$ is derived from two or more of $C_1$, $C_2$, $C_3$, and $C_4$ alkyl (meth)acrylate derived units. In addition, in this embodiment, the outer block ($B_2$) comprises at least 50 mol %, for example, 50 mol % to 100 mol %, further for example, 50 mol % to 98 mol %, of $C_8$ to $C_{32}$, or $C_8$ to $C_{24}$ alkyl (meth)acrylate derived units. In some embodiments, the substantially soluble block ($B_2$) comprises $C_{10}$ to $C_{18}$ alkyl (meth)acrylate derived units, $C_{12}$ to $C_{18}$ alkyl(meth)acrylate derived units, or even $C_{12}$ to $C_{16}$ alkyl (meth)acrylate derived units. In one embodiment, block $B_2$ is derived from two or more of $C_8$, $C_9$, $C_{10}$, $C_{11}$, $C_{12}$, $C_{13}$, $C_{14}$, $C_{15}$, $C_{16}$, $C_{17}$, or $C_{18}$ alkyl (meth)acrylate derived units. In another embodiment, the polymer comprises an inner block ($B_1$) which comprises at least 50 mol %, for example, 50 mol % to 100 mol %, or further for example, 50 mol % to 98 mol % of aromatic (meth)acrylate derived units, such as benzyl methacrylate and an outer block ($B_2$) which comprises at least 50 mol %, for example, 50 mol % to 100 mol %, further for example, 50 mol % to 98 mol %, of $C_8$ to $C_{32}$, or $C_8$ to $C_{24}$ alkyl (meth)acrylate derived units.

In another embodiment, the poly(meth)acrylate copolymer (P) comprises a star polymer having at least three arms, wherein one or more arms comprises an inner block ($B_1$) which contains at least 50 mol %, for example 50 mol % to 99 mol %, or even 50 mol % to 100 mol % methyl(meth) acrylate derived units and an outer block ($B_2$) which contains at least 50 mol %, for example, 50 mol % to 99 mol %, or even 50 mol % to 100 mol % of a mixture of two or more of $C_{12}$, $C_{13}$, $C_{14}$, $C_{15}$, $C_{16}$, $C_{17}$, $C_{18}$ alkyl(meth)acrylate derived units. In one embodiment, the inner block consists of $C_1$ to $C_4$ alkyl (meth)acrylate derived units, such as methyl(meth)acrylate derived units, and the outer block consists of a mixture of two or more of $C_{12}$, $C_{13}$, $C_{14}$, $C_{15}$, $C_{16}$, $C_{17}$, $C_{18}$ alkyl(meth)acrylate derived units.

The molecular weight of the poly(meth)acrylate polymers may be determined using known methods, such as Gel Permeation Chromatography ("GPC" analysis using polystyrene standards. Methods for determining molecular weights of polymers are well known. The methods are described for instance: (i) P. J. Flory, "Principles of Polymer Chemistry", Cornell University Press 91953), Chapter VII, pp 266-315; or (ii) "Macromolecules, an Introduction to Polymer Science", F. A. Bovey and F. H. Winslow, Editors, Academic Press (1979), pp 296-312.

Linear poly(meth)acrylates of the invention as described herein have weight average molecular weight ($M_w$) of 1000 to 400,000 Daltons, or 5,000 to 50,000 Daltons, or even 5,000 to 200,000 Daltons, or even 5000 to 150,000 Daltons, or even 8,000 to 100,000, or 10,000 to 80,000 Daltons.

Radial, cross-linked or star copolymers of the invention may be derived from linear random or di-block copolymers with molecular weights as described above. A star polymer of the invention may have a weight average molecular weight of 10,000 to 1,500,000 Daltons, or 40,000 to 1,000,000 Daltons, or 300,000 to 850,000 Daltons.

The lubricating compositions of the present invention comprise 0.1 wt % to 5 wt %, or 0.25 wt % to 2.5 wt %, or 0.5 to 1.5 wt % of the poly(meth)acrylate copolymer as described herein.

Metal Free Phosphorous Antiwear Agent

The lubricating composition of the invention also contains a metal-free antiwear agent. The metal free antiwear agent may be present at 0.01 wt % to 3 wt %, 0.05 wt % to 2 wt %, or 0.1 to 1.5 wt % of the lubricating composition.

In one embodiment, the metal-free antiwear agent comprises a phosphorous compound. Such phosphorus-containing antiwear agents may be phosphites, phosphonates, alkylphosphate esters, amine or ammonium phosphate salts, or mixtures thereof. The metal-free phosphorus antiwear agent may be present at 0 wt % to 3 wt %, or 0.1 wt % to 1.5 wt %, or 0.5 wt % to 0.9 wt %, or 0.8 wt % to 2.0 wt % of the lubricating composition.

Phosphorus esters such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptylphenol diacid; amine salts of alkyl and dialkylphosphoric acids or derivatives including, for example, the amine salt of a reaction product of a dialkyldithiophosphoric acid with propylene oxide and subsequently followed by a further reaction with $P_2O_5$; and mixtures thereof (as described in U.S. Pat. No. 3,197,405).

Amine phosphates may be amine salts of (i) monohydrocarbylphosphoric acid, (ii) dihydrocarbylphosphoric acid, (iii) hydroxy-substituted di-ester of phosphoric acid, or (iv) phosphorylated hydroxy-substituted di- or tri-ester of phosphoric acid. The amine salt of a metal-free phosphorus-containing compound may be salts of primary amines, secondary amines, tertiary amines, or mixtures thereof.

Amine phosphate salts may be derived from mono- or di-hydrocarbyl phosphoric acid (typically alkyl phosphoric acid), or mixtures thereof. The alkyl of the mono- or di-hydrocarbyl phosphoric acid may comprise linear or branched alkyl groups of 3 to 36 carbon atoms. The hydrocarbyl group of the linear or branched hydrocarbylphosphoric acid may contain 4 to 30, or 8 to 20 carbon atoms. Examples of a suitable hydrocarbyl group of the hydrocarbyl phosphoric acid may include isopropyl, n-butyl, sec-butyl, amyl, 4-methyl-2-pentyl (i.e. methylamyl), n-hexyl, n-heptyl, n-octyl, iso-octyl, 2-ethylhexyl, nonyl, 2-propylheptyl, decyl, dodecyl, tetradecyl, hexadecyl, octadecyl, oleyl, or combinations thereof. In one embodiment, the phosphate is a mixture of mono- and di-(2-ethylhexyl)phosphate.

Examples of suitable primary amines include ethylamine, propylamine, butylamine, 2-ethylhexylamine, octylamine, and dodecylamine, as well as such fatty amines as n-octylamine, n-decylamine, n-dodecylamine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen C, Armeen O, Armeen O L, Armeen T, Armeen H T, Armeen S and Armeen S D, wherein the letter designation relates to the fatty group, such as coco, oleyl, tallow, or stearyl groups.

In one embodiment the amine salt of a phosphoric acid is derived from beta-, gamma-, or delta-amino ester compound, or mixtures thereof. The substituted γ-aminoester may be generally depicted as a material represented by the formula

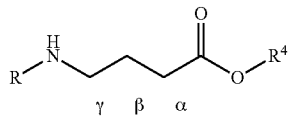

where R may be the hydrocarbyl substituent and $R^4$ may be the residue of the alcohol from which the ester may be envisioned as having been prepared by condensation of an amino acid with an alcohol. If the material may be a thioester, the —$OR^4$ group may be replaced by an —$SR^4$ group. Such a material may be envisioned as derived from the condensation of an acid or acid halide with an appropriate mercaptan $R^4SH$, although in practice it may be prepared by transesterification of an ester with a mercaptan. In one embodiment hydrocarbyl group (R) may be selected such that there is a substituent at the α or β position of the hydrocarbyl chain.

In one embodiment the amine salt of a phosphoric acid is derived from beta-, gamma-, or delta-amino ester compound, or mixtures thereof. In one embodiment the amine phosphate may be derived from aromatic amines, i.e. amines substituted with one or more aryl groups. The aryl groups may be substituted, unsubstituted, or combinations thereof. The aryl groups may be substituted with hydrocarbyl groups, acyl groups, hydroxy groups, alkoxy groups, and combinations thereof. Examples of suitable aromatic amines include anilines, diphenylamines, phenylene diamines, and derivatives thereof.

In one embodiment, the aromatic amine phosphate is a phosphate salt of an aniline compound represented by the formula

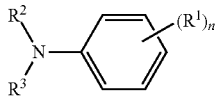

where n=0, 1, or 2; each $R^1$ is independently selected from a hydrocarbyl group of 1 to 20 carbon atoms, —C(=O)X$R^4$, —O$R^5$, or combinations thereof; $R^2$ and $R^3$ are independently hydrogen or an aliphatic hydrocarbyl group of 1 to 12 carbon atoms; X is oxygen or —N$R^6$—; $R^4$ is selected from a hydrocarbyl group of 1 to 24 carbon atoms, a (poly)ether group according to the formula —$(CH_2CHR^7O)_m$—$R^8$, or combinations thereof; $R^5$ is hydrogen, a hydrocarbyl group of 1 to 24 carbon atoms, a (poly)ether group according to the formula —$(CH_2CHR^7O)_m$—$R^8$; $R^6$ is hydrogen or a hydrocarbyl group of 1 to 12 carbon atoms; m is an integer from 1 to 20; each $R^7$ is independently hydrogen, a hydrocarbyl group of 1 to 20 carbon atoms, or combinations thereof; and R8 is hydrogen or a hydrocarbyl group of 1 to 24 carbon atoms. Suitable aniline compounds include N,N-dihydrocarbylanilines, such as N,N-di(hexyl)aniline; hydrocarbyl esters of anthranilic acid, such as methyl-, ethyl-, propyl-, butyl-, hexyl-, octyl, iso-octyl, 2-ethylhexyl, decyl-, isodecyl-, dodecyl-, tridecyl-, isotridecyl, hexadecyl-, oleyl, stearyl-esters and combinations thereof and alkoxy-substituted anilines, such as p-anisidine, p-ethoxyaniline, and N,N-di(2-ethylhexyl)-p-ethoxyaniline.

In one embodiment, the aromatic amine phosphate is a phosphate salt of a diaryl amine compound represented by the formula

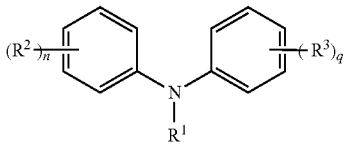

where $R^1$ is selected from hydrogen, a hydrocarbyl group of 1 to 24 carbon atoms, an acyl-containing group according to the formula —$CH_2CH_2$(C=O)O$R^4$, an alkoxylate according to the formula —$(CH_2CHR^5O)_m$—$R_6$, or combinations thereof; $R^2$ and $R^3$ are each independently hydrocarbyl groups of 4 to 18 carbon atoms; each n and q is independently 0, 1, or 2; $R^4$ is a hydrocarbyl group of 1 to 18 carbon atoms; each $R^5$ is independently hydrogen or a hydrocarbyl group of 1 to 18 carbon atoms; $R^6$ is hydrogen or a hydrocarbyl group of 1 to 18 carbon atoms; and m is an integer from 1 to 20. When either n or q is 2 and the two hydrocarbyl groups ($R^2$ or $R^3$ as applicable) are on adjacent carbons of the ring, they may be taken together to form 5- or 6-membered rings that may be saturated, unsaturated, or aromatic. Suitable diaryl amine compounds include diphenylamine, phenyl-α-naphthylamine, alkylated diphenyl amine, alkylated phenyl-α-naphthylamine, and combinations thereof. Alkylated diarylamines may have one, two, three, or even four alkyl groups; alkyl groups may be branched or linear and contain 4 to 18 carbon atoms, 6 to 12 carbon atoms, or 8 to 10 carbon atoms.

In one embodiment, the aromatic amine phosphate is a phosphate salt of a phenylene diamine compound represented by the formula

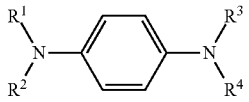

where $R^1$, $R^2$, $R^3$, and $R^4$ are each independently hydrogen, or a hydrocarbyl group of 1 to 24 carbon atoms, and wherein at least one of $R^1$, $R^2$, $R^3$, and $R^4$ is not a hydrogen atom. Examples of suitable phenylene diamine compounds include N,N,N'N'-tetrapentyl-phenylenediamine, and N,N'-di(2-ethylhexyl)-N,N'-di(sec-butyl)-phenylenediamine.

In another embodiment the metal-free antiwear agent may be a sulfurized-olefin. The sulfurized olefin may be a polysulfide.

In an embodiment the sulfurized-olefin includes dihydrocarbyl polysulfides; sulfurized olefins; sulfurized fatty acid esters of both natural and synthetic origins; trithiones; sulfurized thienyl derivatives; sulfurized terpenes; sulfurized oligomers of C2-C8 monoolefins; and sulfurized Diels-Alder adducts such as those disclosed in U.S. Pat. No. Re 27,331. Specific examples include sulfurized polyisobutene, sulfurized isobutylene, sulfurized diisobutylene, sulfurized triisobutylene, dicyclohexyl polysulfide, diphenyl polysulfide, dibenzyl polysulfide, dinonyl polysulfide, and mixtures of di-tert-butyl polysulfide such as mixtures of di-tert-butyl trisulfide, di-tert-butyl tetrasulfide and di-tert-butyl pentasulfide, among others. Combinations of such categories of sulfur-containing antiwear and/or extreme pressure agents may also be used, such as a combination of sulfurized isobutylene and di-tert-butyl trisulfide, a combination of sulfurized isobutylene and dinonyl trisulfide, a combination of sulfurized tall oil and dibenzyl polysulfide.

In a further embodiment at least 50 wt % of the polysulfide molecules are a mixture of tri- or tetra-sulfides. In other embodiments at least 55 wt %, or at least 60 wt % of the polysulfide molecules are a mixture of tri- or tetra-sulfides.

The polysulfide includes a sulfurized organic polysulfide from oils, fatty acids or ester (such as ester-containing sulfurized olefin), olefins or polyolefins.

Oils which may be sulfurized include natural or synthetic oils such as mineral oils, lard oil, carboxylate esters derived from aliphatic alcohols and fatty acids or aliphatic carboxylic acids (e.g., myristyl oleate and oleyl oleate), and synthetic unsaturated esters or glycerides.

Fatty acids include those that contain 8 to 30, or 12 to 24 carbon atoms. Examples of fatty acids include oleic, linoleic, linolenic, and tall oil. Sulfurized fatty acid esters prepared from mixed unsaturated fatty acid esters such as are obtained from animal fats and vegetable oils, including tall oil, linseed oil, soybean oil, rapeseed oil, and fish oil.

The polysulfide includes olefins derived from a wide range of alkenes. The alkenes typically have one or more double bonds. The olefins in one embodiment contain 3 to 30 carbon atoms. In other embodiments, olefins contain 3 to 16, or 3 to 9 carbon atoms. In one embodiment the sulfurized olefin includes an olefin derived from propylene, isobutylene, pentene or mixtures thereof.

In another embodiment the polysulfide comprises a polyolefin derived from polymerizing by known techniques, an olefin as described above.

In still another embodiment the polysulfide includes dibutyl tetrasulfide, sulfurized methyl ester of oleic acid, sulfurized alkylphenol, sulfurized dipentene, sulfurized dicyclopentadiene, sulfurized terpene, and sulfurized Diels-Alder adducts.

In a further embodiment the sulfurized olefin may be an ester-containing sulfurized olefin. The ester-containing sulfurized olefin may include a sulfurized 4-carbobutoxy cyclohexene.

In one embodiment, the invention provides a lubricating composition which further includes an antiwear agent different from the metal-free phosphorus antiwear agent described above. Examples of suitable antiwear agents include titanium compounds, hydroxy-carboxylic acid derivatives such as esters, amides, imides or amine or ammonium salt, sulfurised olefins, thiocarbamate-containing compounds, such as thiocarbamate esters, thiocarbamate amides, thiocarbamic ethers, alkylene-coupled thio¬carbamates, and bis(S-alkyldithiocarbamyl) disulfides. Suitable hydroxy-carboxylic acid derivatives include tartaric acid derivatives, malic acid derivatives, citric acid derivatives, glycolic acid derivatives, lactic acid derivatives, and mandelic acid derivatives.

In another embodiment, the antiwear agent may in one embodiment include a tartrate or tartrimide as disclosed in International Publication WO 2006/044411 or Canadian Patent CA 1 183 125. The tartrate or tartrimide may contain alkyl-ester groups, where the sum of carbon atoms on the alkyl groups is at least 8. The antiwear agent may in one embodiment include a citrate as is disclosed in US Patent Application 20050198894

In one embodiment, the hydroxy-carboxylic acid ashless antiwear agent may be represented by Formula:

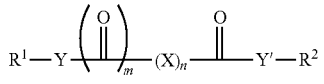

wherein Y and Y' are independently —O—, >NH, >$NR^3$, or an imide group formed by taking together both Y and Y' groups and forming a $R^1$—N< group between two >C=O groups; X is independently —Z—O—Z'—, >$CH_2$, >$CHR^4$, >$CR^4R^5$, >C(OH)($CO_2R^2$), >C($CO_2R^2$)$_2$, or >$CHOR^6$; Z and Z' are independently >$CH_2$, >$CHR^4$, >$CR^4R^5$, >C(OH)($CO_2R^2$), or >$CHOR^6$; n is 0 to 10, with the proviso that when n=1, X is not >$CH_2$, and when n=2, both X's are not >$CH_2$; m is 0 or 1; $R^1$ is independently hydrogen or a hydrocarbyl group, typically containing 1 to 150 carbon atoms, with the proviso that when $R^1$ is hydrogen, m is 0, and n is more than or equal to 1; $R^2$ is a hydrocarbyl group, typically containing 1 to 150 carbon atoms; $R^3$, $R^4$ and $R^5$ are independently hydrocarbyl groups; and $R^6$ is hydrogen or a hydrocarbyl group, typically containing 1 to 150 carbon atoms.

In some embodiments, the metal free anti-wear agent used in the lubricating composition of the present invention is a phosphorous free anti-wear agent. In another embodiment, the metal free anti-wear agent used in the lubricating composition of the present invention is a sulfur free anti-wear agent. In still another embodiment, the metal free anti-wear agent used in the lubricating composition of the present invention is both phosphorous free and sulfur free.

The ashless phosphorus-free antiwear agent may be present at 0 wt % to 3 wt %, or 0.1 wt % to 1.5 wt %, or 0.5 wt % to 1.1 wt % of the lubricating composition.

In one embodiment, the lubricating composition of the present invention comprises (a) a base oil having a kinematic viscosity (ASTM D445 test method) measured at 100° C. of 2.4 $mm^2/s$ to 4.6 $mm^2/s$; (b) 0.08 weight percent to 5 weight percent of a ethylene-α-olefin copolymer, wherein the ethylene-α-olefin copolymer is grafted with 1.5% to 3.5% by weight of an acylating agent and an equivalent mole percent of a hydrocarbyl amine, wherein the functionalized ethylene-α-olefin copolymer has a weight average molecular weight of 100,000 up to 175,000; and (c) 0.3 weight percent to 5 weight percent of a poly(meth)acrylate polymer wherein the poly(meth)acrylate polymer comprises a block or tapered block copolymer (P) comprising a first block ($B_1$) which is substantially insoluble in the base oil and a second block ($B_2$) which is substantially soluble in the base oil, wherein the first block ($B_1$) comprises or consists of at least 50 mol % at least two of $C_1$, $C_2$, $C_3$ or $C_4$ (meth)acrylate derived units and the second block ($B_2$) comprises or consists of at least 50 mol % of at least two of $C_{12}$, $C_{13}$, $C_{14}$, $C_{15}$, $C_{16}$, $C_{17}$, or $C_{18}$ (meth)acrylate derived units wherein the dynamic viscosity measured according to ASTM D4683 of the lubricating composition under shear at 150° C. is 1.4 mPa·s to 2.8 mPa·s. The lubricating composition may further contain one or more additional performance additives as described below.

Other Performance Additives

A lubricating composition may be prepared by adding the product of the process described herein to an oil of lubricating viscosity, optionally in the presence of other performance additives (as described herein below).

The lubricating composition of the invention optionally comprises other performance additives. The other performance additives include at least one of metal deactivators, viscosity modifiers, detergents, friction modifiers, corrosion inhibitors, dispersants, extreme pressure agents, antioxidants, foam inhibitors, demulsifiers, pour point depressants, seal swelling agents and mixtures thereof. Typically, fully-formulated lubricating oil will contain one or more of these performance additives.

In one embodiment the invention provides a lubricating composition further comprising an overbased metal-containing detergent. The metal of the metal-containing detergent may be zinc, sodium, calcium, barium, or magnesium. Typically the metal of the metal-containing detergent may be sodium, calcium, or magnesium.

The overbased metal-containing detergent may be selected from the group consisting of non-sulfur containing phenates, sulfur containing phenates, sulfonates, salixarates, salicylates, and mixtures thereof, or borated equivalents thereof. The overbased detergent may be borated with a borating agent such as boric acid.

The overbased metal-containing detergent may also include "hybrid" detergents formed with mixed surfactant systems including phenate and/or sulfonate components, e.g. phenate/salicylates, sulfonate/phenates, sulfonate/salicylates, sulfonates/phenates/salicylates, as described; for example, in U.S. Pat. Nos. 6,429,178; 6,429,179; 6,153,565; and 6,281,179. Where, for example, a hybrid sulfonate/phenate detergent is employed, the hybrid detergent would be considered equivalent to amounts of distinct phenate and sulfonate detergents introducing like amounts of phenate and sulfonate soaps, respectively.

Typically, an overbased metal-containing detergent may be a zinc, sodium, calcium or magnesium salt of a phenate, sulfur containing phenate, sulfonate, salixarate or salicylate. Overbased salixarates, phenates and salicylates typically have a total base number of 180 to 450 TBN. Overbased sulfonates typically have a total base number of 250 to 600, or 300 to 500. Overbased detergents are known in the art. In one embodiment the sulfonate detergent may be a predominantly linear alkylbenzene sulfonate detergent having a metal ratio of at least 8 as is described in paragraphs [0026] to [0037] of US Patent Application 2005065045 (and granted as U.S. Pat. No. 7,407,919). The predominantly linear alkylbenzene sulfonate detergent may be particularly useful for assisting in improving fuel economy.

Typically, the overbased metal-containing detergent may be a calcium or magnesium an overbased detergent.

Overbased detergents are known in the art. Overbased materials, otherwise referred to as overbased or superbased salts, are generally single phase, homogeneous Newtonian systems characterized by a metal content in of that which would be present for neutralization according to the stoichiometry of the metal and the particular acidic organic compound reacted with the metal. The overbased materials are prepared by reacting an acidic material (typically an inorganic acid or lower carboxylic acid, preferably carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter such as a calcium chloride, acetic acid, phenol or alcohol. The acidic organic material will normally have a sufficient number of carbon atoms to provide a degree of solubility in oil. The amount of "excess" metal (stoichiometrically) is commonly expressed in terms of metal ratio. The term "metal ratio" is the ratio of the total equivalents of the metal to the equivalents of the acidic organic compound. A neutral metal salt has a metal ratio of one. A salt having 3.5 times as much metal as present in a normal salt will have metal excess of 3.5 equivalents, or a ratio of 4.5. The term "metal ratio is also explained in standard textbook entitled "Chemistry and Technology of Lubricants", Third Edition, Edited by R. M. Mortier and S. T. Orszulik, Copyright 2010, page 219, sub-heading 7.25.

In another embodiment the lubricating composition further comprises a calcium sulfonate overbased detergent and a calcium phenate overbased detergent in an amount such that the sulfated ash content is 1000 ppm or less (such as 100 ppm to 1000 ppm, or 300 ppm to 900 ppm).

The lubricating composition may further comprise a zinc dialkyldithiophosphate anti-wear agent. Zinc dialkyldithiophosphates are known in the art. Examples of zinc dithiophosphates include zinc isopropyl methylamyl dithiophosphate, zinc isopropyl isooctyl dithiophosphate, zinc di(cyclohexyl) dithiophosphate, zinc isobutyl 2-ethylhexyl dithiophosphate, zinc isopropyl 2-ethylhexyl dithiophosphate, zinc isobutyl isoamyl dithiophosphate, zinc isopropyl n-butyl dithiophosphate, and combinations thereof. Zinc dialkyldithiophosphate may be present in amount to provide 0 weight percent to 0.03 weight percent phosphorus to the lubricating composition.

In one embodiment, the lubricating composition is free of or substantially free of zinc dialkyldithiophosphate (typically 0 ppm to 250 ppm, or 0 to 100 ppm or 0 to 50 ppm of zinc, or 0 ppm of zinc by weight).

The lubricating composition in a further embodiment comprises an antioxidant, wherein the antioxidant comprises a phenolic or an aminic antioxidant or mixtures thereof. The antioxidants include diarylamines, alkylated diarylamines, hindered phenols, or mixtures thereof. When present the antioxidant is present at 0.1 wt % to 3 wt %, or 0.5 wt % to 2.75 wt %, or 1 wt % to 2.5 wt % of the lubricating composition.

The diarylamine or alkylated diarylamine may be a phenyl-α-naphthylamine (PANA), an alkylated diphenylamine, or an alkylated phenylnapthylamine, or mixtures thereof. The alkylated diphenylamine may include di-nonylated diphenylamine, nonyl diphenyl amine, octyl diphenylamine, di-octylated diphenylamine, di-decylated diphenylamine, decyl diphenylamine and mixtures thereof. In one embodiment the diphenylamine may include nonyl diphenylamine, dinonyl diphenylamine, octyl diphenylamine, dioctyl diphenylamine, or mixtures thereof. In another embodiment the alkylated diphenylamine may include nonyl diphenylamine, or dinonyl diphenylamine. The alkylated diarylamine may include octyl, di-octyl, nonyl, di-nonyl, decyl or di-decyl phenylnapthylamines.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

In one embodiment, the antioxidant may comprise an oxyalkylated hydrocarbyl phenol. In one embodiment, an axyalkylated hydrocarbyl phenol may be represented by the formula:

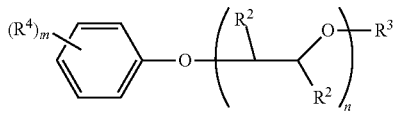

wherein each $R^2$ may be independently hydrogen or a hydrocarbyl group of 1 to 6 carbon atoms;

$R^3$ may be hydrogen, a hydrocarbyl group of 1 to 24 carbon atoms, or an acyl group represented by —C(=O)$R^5$, $R^5$ may be a hydrocarbyl group of 1 to 24 carbon atoms;

each $R^4$ may be independently a hydrocarbyl group of 1 to 250 carbon atoms (typically wherein at least one $R^4$ contains 20 to 220, or 30 to 150, 35 to 140, or 40 to 96 carbon atoms);

n=1 to 20, or 1 to 10; and m=1 to 3.

An oxyalkylated hydrocarbyl phenol may also be represented by the formula:

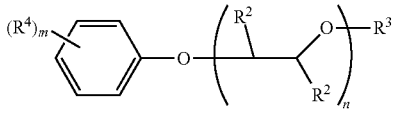

wherein one $R^2$ may be methyl, and the second $R^2$ may be hydrogen;

$R^3$ may be hydrogen, a hydrocarbyl group of 1 to 24 carbon atoms, or an acyl group represented by —C(=O)$R^5$, $R^5$ may be a hydrocarbyl group of 1 to 24 carbon atoms;

each $R^4$ may be a hydrocarbyl group of 20 to 220, or 30 to 150, 35 to 140, or 40 to 96 carbon atoms;

n=1 to 20, or 1 to 10; and m=1.

The oxyalkylated hydrocarbyl phenol may also be represented by the formula:

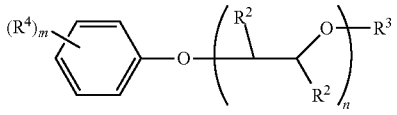

wherein one $R^2$ may be methyl, and the second $R^2$ may be hydrogen;

$R^3$ may be hydrogen, a hydrocarbyl group of 1 to 24 carbon atoms, or an acyl group represented by —C(=O)$R^5$, $R^5$ may be a hydrocarbyl group of 1 to 24 carbon atoms;

$R^4$ may be a hydrocarbyl group of 1 to 220 carbon atoms, wherein at least one $R^4$ comprises a polyalk(en)yl group containing 30 to 150, 35 to 140, or 40 to 96, 35 to 140, or 35 to 96 carbon atoms;

n=1 to 8, or 2 to 8; and m=1.

In another embodiment, the oxyalkylated hydrocarbyl phenol may be represented by the formula:

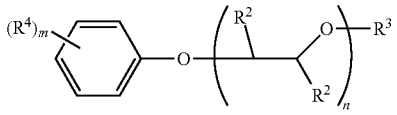

wherein one $R^2$ may be methyl, and the second $R^2$ may be hydrogen;

$R^3$ may be hydrogen, a hydrocarbyl group of 1 to 24 carbon atoms, or an acyl group represented by —C(=O)$R^5$, $R^5$ may be a hydrocarbyl group of 1 to 24 carbon atoms;

each a hydrocarbyl group of 1 to 220 carbon atoms comprises a polyisobutenyl group containing 35 to 140, or 35 to 96 carbon atoms;

n=1 to 8, or 2 to 8 (or 3 to 5); and m=1.

The $R^4$ group of each of the formulae above may be located in the para-position relative to the oxyalkylated group, and the resultant formula may be represented by structure:

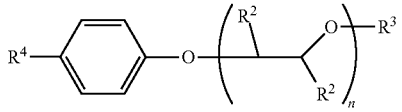

wherein variables $R^2$ to $R^5$, n, and m are defined previously.

In one embodiment, the oxyalkylated hydrocarbyl phenol of the disclosed technology may be represented by the formula:

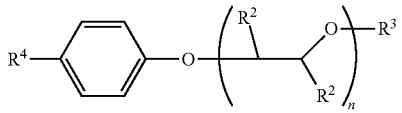

wherein $R^4$ may be a polyolefinic group such as a polypropenyl or a polyisobutenyl group (typically a polyisobutenyl group), and variables $R^2$, $R^3$, $R^5$, and n are defined previously. The polyisobutenyl group may have a number average molecular weight of 350 to 2500, or 550 to 2300, or 750 to 1150. In one embodiment the polyisobutenyl group has a number average molecular weight of 950-1000. The polypropenyl group may have a number average molecular weight of 740 to 1200, or 800-850. In one embodiment the polypropenyl group has a number average molecular weight of 825.

In another embodiment the oxyalkylated hydrocarbyl phenol of the disclosed technology may be represented by the formula:

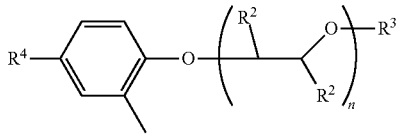

wherein $R^4$ may be a polyolefinic group such as a polypropenyl or a polyisobutenyl group (typically a polyisobutenyl group), and variables $R^2$, $R^3$, $R^5$, and n, are defined previously. The polyisobutenyl group may have a number average molecular weight of 350 to 2500, or 550 to 2300, or 750 to 1150. In one embodiment the polyisobutenyl group has a number average molecular weight of 950-1000.

In some embodiments, the oxyalkylated group of the oxyalkylated hydrocarbyl phenol has formula —$(R^1O)_n$—, wherein $R^1$ may be an ethylene, propylene, butylene group, or mixtures thereof; and n may independently be from 1 to 50, or 1 to 20, or 1 to 10, or 2 to 5.

The lubricating composition may in a further embodiment include a dispersant, or mixtures thereof. The dispersant may be a succinimide dispersant, a Mannich dispersant, a succinamide dispersant, a polyolefin succinic acid ester, amide, or ester-amide, or mixtures thereof. In one embodiment the dispersant may be present as a single dispersant. In one embodiment the dispersant may be present as a mixture of two or three different dispersants, wherein at least one may be a succinimide dispersant.

The succinimide dispersant may be derived from an aliphatic polyamine, or mixtures thereof. The aliphatic polyamine may be aliphatic polyamine such as an ethylenepolyamine, a propylenepolyamine, a butylenepolyamine, or mixtures thereof. In one embodiment the aliphatic polyamine may be ethylenepolyamine. In one embodiment the aliphatic polyamine may be selected from the group consisting of ethylenediamine, diethylenetriamine, triethylenetetramine, tetraethylene-pentamine, pentaethylenehexamine, polyamine still bottoms, and mixtures thereof.

In one embodiment the dispersant may be a polyolefin succinic acid ester, amide, or ester-amide. For instance, a polyolefin succinic acid ester may be a polyisobutylene succinic acid ester of pentaerythritol, or mixtures thereof. A polyolefin succinic acid ester-amide may be a polyisobutylene succinic acid reacted with an alcohol (such as pentaerythritol) and a polyamine as described above.

The dispersant may be an N-substituted long chain alkenyl succinimide. An example of an N-substituted long chain alkenyl succinimide is polyisobutylene succinimide. Typically the polyisobutylene from which polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and U.S. Pat. Nos. 6,165,235, 7,238,650 and EP Patent Application 0 355 895 A.

The dispersant may be a polyalphaolefin succinimide, a polyalphaolefin succinamide, a polyalphaolefin acid ester, a polyalphaolefin oxazoline, a polyalphaolefin imidazoline, a polyalphaolefin succinamide imidazoline, and combinations thereof. Polyalphaolefins (PAO) useful as feedstock in forming the dispersants are those derived from oligomerization or polymerization of ethylene, propylene, and .alpha.-olefins. Suitable .alpha.-olefins include 1-butene, 1-pentene, 1-hexene, 1-heptene, 1-octene, 1-nonene, 1-decene, 1-undecene, 1-dodecene, 1-tetradecene, and 1-octadecene. Feedstocks containing a mixture of two or more of the foregoing monomers as well as other hydrocarbons are typically employed when manufacturing PAOs commercially. The PAO may take the form of dimers, trimers, tetramers, polymers, and the like.

The PAO used to prepare PAO-based dispersants may have a $M_w$ of 450 to 24,000 Daltons, 600 to 18,000 Daltons, 600 to 14,000 Daltons, 600 to 7,500 Daltons, or 600 to 4,000 Daltons. The PAO may have a $M_n$ (number-average molecular weight) of 280 to 12,000, 500 to 9,000, 500 to 6,000, 500 to 4,400, 400 to 1,000, or 400 to 800. The PAO may have a $M_w/M_n$ or molecular weight distribution of 1.1 to 3.0, preferably 1.2 to 2.5, and most preferably 1.3 to 2.2.

The dispersants may also be post-treated by conventional methods by a reaction with any of a variety of agents. Among these are boron compounds (such as boric acid), urea, thiourea, dimercaptothiadiazoles, carbon disulfide, aldehydes, ketones, carboxylic acids such as terephthalic acid, hydrocarbon-substituted succinic anhydrides, maleic anhydride, nitriles, epoxides, and phosphorus compounds. In one embodiment the post-treated dispersant is borated. In one embodiment the post-treated dispersant is reacted with dimercaptothiadiazoles. In one embodiment the post-treated dispersant is reacted with phosphoric or phosphorous acid. In one embodiment the post-treated dispersant is reacted with terephthalic acid and boric acid (as described in US Patent Application US2009/0054278.

When present, the dispersant may be present at 0.01 wt % to 20 wt %, or 0.1 wt % to 15 wt %, or 0.1 wt % to 10 wt %, or 1 wt % to 6 wt %, or 1 to 3 wt % of the lubricating composition.

In one embodiment the friction modifier may be selected from the group consisting of long chain fatty acid derivatives of amines, long chain fatty esters, or derivatives of long chain fatty epoxides; fatty imidazolines; amine salts of alkylphosphoric acids; fatty alkyl tartrates; fatty alkyl tartrimides; fatty alkyl tartramides; fatty glycolates; and fatty glycolamides. The friction modifier may be present at 0 wt % to 6 wt %, or 0.01 wt % to 4 wt %, or 0.05 wt % to 2 wt %, or 0.1 wt % to 2 wt % of the lubricating composition.

As used herein the term "fatty alkyl" or "fatty" in relation to friction modifiers means a carbon chain having 10 to 22 carbon atoms, typically a straight carbon chain.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty alkyl tartrates; fatty alkyl tartrimides; fatty alkyl tartramides; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

Friction modifiers may also encompass materials such as sulfurized fatty compounds and olefins, molybdenum dialkyldithiophosphates, molybdenum dithiocarbamates, sunflower oil or soybean oil monoester of a polyol and an aliphatic carboxylic acid.

In another embodiment the friction modifier may be a long chain fatty acid ester. In another embodiment the long chain fatty acid ester may be a mono-ester and in another embodiment the long chain fatty acid ester may be a triglyceride.

Another class of additives includes oil-soluble titanium compounds as disclosed in U.S. Pat. No. 7,727,943 and US2006/0014651. The oil-soluble titanium compounds may function as additional antiwear agents, friction modifiers, antioxidants, deposit control additives, or more than one of these functions. In one embodiment the oil soluble titanium compound is a titanium (IV) alkoxide. The titanium alkoxide is formed from a monohydric alcohol, a polyol or mixtures thereof. The monohydric alkoxides may have 2 to 16, or 3 to 10 carbon atoms. In one embodiment, the titanium alkoxide is titanium (IV) isopropoxide. In one embodiment, the titanium alkoxide is titanium (IV) 2-ethylhexoxide. In one embodiment, the titanium compound comprises the alkoxide of a vicinal 1,2-diol or polyol. In one embodiment, the 1,2-vicinal diol comprises a fatty acid mono-ester of glycerol, often the fatty acid is oleic acid.

In one embodiment, the oil soluble titanium compound is a titanium carboxylate. In a further embodiment the titanium (IV) carboxylate is titanium neodecanoate.

Extreme Pressure (EP) agents that are soluble in the oil include sulfur- and chlorosulfur-containing EP agents, dimercaptothiadiazole or $CS_2$ derivatives of dispersants (typically succinimide dispersants), derivative of chlorinated hydrocarbon EP agents and phosphorus EP agents. Examples of such EP agents include chlorinated wax; sulfurized olefins (such as sulfurized isobutylene), a hydrocarbyl-substituted 2,5-dimercapto-1,3,4-thiadiazole, or oligomers thereof, organic sulfides and polysulfides such as dibenzyldisulfide, bis-(chlorobenzyl) disulfide, dibutyl tetrasulfide, sulfurized methyl ester of oleic acid, sulfurized alkylphenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptylphenol diacid; amine salts of alkyl and dialkylphosphoric acids or derivatives including, for example, the amine salt of a reaction product of a dialkyldithiophosphoric acid with propylene oxide and subsequently followed by a further reaction with $P_2O_5$; and mixtures thereof (as described in U.S. Pat. No. 3,197,405).

Foam inhibitors that may be useful in the compositions of the invention include polysiloxanes, copolymers of ethyl acrylate and 2-ethylhexylacrylate and optionally vinyl acetate; demulsifiers including fluorinated polysiloxanes, trialkyl phosphates, polyethylene glycols, polyethylene oxides, polypropylene oxides and (ethylene oxide-propylene oxide) polymers.

Pour point depressants that may be useful in the compositions of the invention include polyalphaolefins, esters of maleic anhydride-styrene copolymers, poly(meth)acrylates, polyacrylates or polyacrylamides.

Demulsifiers include trialkyl phosphates, and various polymers and copolymers of ethylene glycol, ethylene oxide, propylene oxide, or mixtures thereof.

Metal deactivators include derivatives of benzotriazoles (typically tolyltriazole), 1,2,4-triazoles, benzimidazoles, 2-alkyldithiobenzimidazoles or 2-alkyldithiobenzothiazoles. The metal deactivators may also be described as corrosion inhibitors.

Seal swell agents include sulfolene derivatives Exxon Necton-37™ (FN 1380) and Exxon Mineral Seal Oil™ (FN 3200).

INDUSTRIAL APPLICATION

The internal combustion engine may be a 4-stroke engine. The internal combustion engine may or may not have an Exhaust Gas Recirculation system. The internal combustion engine may be fitted with an emission control system or a turbocharger. Examples of the emission control system include diesel particulate filters (DPF), or systems employing selective catalytic reduction (SCR).

In one embodiment the internal combustion engine may be a diesel fueled engine, a gasoline fueled engine, a natural gas fueled engine or a mixed gasoline/alcohol fueled engine. In one embodiment the internal combustion engine may be a diesel fueled engine and in another embodiment a gasoline fueled engine. In one embodiment the internal combustion engine may be a heavy duty diesel engine. In still another embodiment, the internal combustion engine may be a gasoline direct injection engine.

The sulfur content of the lubricating composition may be 1 wt % or less, or 0.8 wt % or less, or 0.5 wt % or less, or 0.3 wt % or less. In one embodiment the sulfur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or even 0.06 wt % or less, 0.055 wt % or less, or 0.05 wt % or less. In one embodiment the phosphorus content may be 0.04 wt % to 0.12 wt %. In one embodiment the phosphorus content may be 100 ppm to 1000 ppm, or 200 ppm to 600 ppm. The total sulfated ash content may be 0.3 wt % to 1.2 wt %, or 0.5 wt % to 1.1 wt % of the lubricating composition. In one embodiment the sulfated ash content may be 0.5 wt % to 1.1 wt % of the lubricating composition.

The lubricating composition may have a SAE viscosity grade of XW-Y, wherein X may be 0, 5, 10, or 15; and Y may be 16, 20, 30, or 40.

In one embodiment of the invention, the lubricating composition as described herein will have an evaporative percent weight loss (Noack), as measured by ASTM D5800, of less than 15% or of less than 14%, or less than 13%.

The following examples provide illustrations of the invention. These examples are non-exhaustive and are not intended to limit the scope of the invention.

EXAMPLES

Lubricating oil compositions were prepared and tested as summarized in Table 1.

TABLE 1

| Lubricating Compositions[1] | | | |
|---|---|---|---|
| | EX 1 | EX 2 | EX 3 |
| | Balance to 100% | | |
| Group III Base Oil | | | |
| Functionalized ethylene-alphaolefin compound[1] | 2 | | 1 |
| PMA[3] | | 2.5 | 2.5 |
| Oleyl tartrimide (Ashless AW/FM) | 0.48 | 0.48 | 0.48 |
| Amine phosphate (ashless AW)[4] | 1 | 1 | 1 |
| Sulfurized olefin | 0.5 | 0.5 | 0.5 |
| Alkylated diphenyl amine AO | 2 | 2 | 2 |
| Thioether substituted hindered phenol AO | 2 | 2 | 2 |
| Low metal ratio Calcium sulfonate detergent | 0.15 | 0.15 | 0.15 |
| Overbased Magnesium sulfonate detergent | 0.46 | 0.46 | 0.46 |
| Calcium salixarate detergent | 0.8 | 0.8 | 0.8 |
| Quaternized PIBsuccinimide dispersant | 1.5 | 1.5 | 1.5 |
| High TBN PIBsuccinimide | 1 | 1 | 1 |
| PIB-ester dispersant | 0.56 | 0.56 | 0.56 |
| Propoxylated p-alkylphenol[5] | 3 | 3 | 3 |
| Other additives[6] | 0.22 | 0.22 | 0.22 |
| % Phosphorus | 0.056 | 0.056 | 0.059 |
| % Calcium | 0.082 | 0.082 | 0.083 |
| % Magnesium | 0.078 | 0.077 | 0.078 |
| TBN | 8.2 | 8.6 | |
| Sulfated Ash (calculated) | 0.65 | 0.65 | 0.65 |
| VISCOSITY @100° C. cSt (ASTM D445) | 6.72 | 6.66 | 6.86 |
| VI (ASTM D2270) | 136 | 145 | 144 |
| Base Oil Viscosity (100° C.)* (ASTM D445) | 4.4 | 4.4 | 4.3 |
| HTHS cP (ASTM D4683) | 2.27 | 2.33 | 2.34 |
| VW TDI Engine Test | | | |
| PSTN_CLNESS_AVG | 66 | 60 | 63 |
| RING_STCKNG_AVG | 0 | 0 | 0 |
| NO_OF_RINGS | 0 | 0 | 0 |
| Peugeot Lash Adjustor - Visual Rating | | | |
| UPPER_AREA | 5.06 | 5.27 | 6.79 |
| LOWER_AREA | 7.75 | 8.16 | 8.53 |

[1]All treat rates on an oil-free basis unless otherwise noted

2. Ethylene-propylene copolymer functionalized with 3% by weight maleic anhydride and imidated with a molar equivalent of 3-nitroaniline; treat includes 87% oil

[3]b-LMA-b-MMA copolymer cross-linked with EGDMA

[4]Diarylamine salted alkylphosphoric acid

[5]Alkyl group is derived from ~1000 Mn polyisobutylene

[6]Other additives include foam inhibitor, corrosion inhibitor, and pourpoint depressant The results obtained from the DW10 lash adjuster test indicate that a lubricating composition defined by the present invention provides unexpectedly better results than compositions outside the scope of the claimed invention.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008147704, or a similar definition in paragraphs [0137] to [0141] of published application US 2010-0197536.

As used herein the detergent total base number (TBN) may be measure by ASTM D2896.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising (a) a base oil having a kinematic viscosity (ASTM D445 test method) measured at 100° C. of 2.0 $mm^2/s$ to 5.0 $mm^2/s$;

(b) 0.08 weight percent to 5 weight percent of a ethylene-α-olefin copolymer, wherein the ethylene-α-olefin copolymer is grafted with a polar moiety;

(c) 0.3 weight percent to 5 weight percent of a poly(meth) acrylate polymer, wherein the poly(meth)acrylate polymer comprises a block or tapered block copolymer (P) comprising a first block (B1) which is substantially insoluble in the base oil and consists essentially of C1 to C4 alkyl (meth)acrylate derived units and a second block (B2) which is substantially soluble in the base oil and consists essentially of C8 to C24 alkyl (meth) acrylate derived units; and (d) 0.05 weight percent to 5 weight percent of a metal-free anti-wear agent;

wherein the dynamic viscosity measured according to ASTM D4683 of the lubricating composition under shear at 150° C. is 1.4 mPa·s to 2.8 mPa·s.

2. The lubricating composition of claim 1, wherein the polar moiety of the ethylene-α-olefin copolymer comprises an acyl group.

3. The lubricating composition of claim 2, wherein the acyl group is provided by an ethylenically unsaturated acylating agent.

4. The lubricating composition of claim 2, wherein the acyl group is provided by an acylating agent selected from the group consisting of maleic anhydride, itaconic anhydride, chlormaleic anhydride, maleic acid, fumaric acid, (meth)acrylic acid, cinnamic acid, reactive esters of any of the foregoing, reactive chlorides of any of the foregoing, and combinations thereof.

5. The lubricating composition of claim 2, wherein the ethylene-α-olefin copolymer is further functionalized with a hydrocarbyl amine or hydrocarbyl alcohol capable of reacting with the acyl group to form an amide, imide, or ester linkage.

6. The lubricating composition of claim 5, wherein the ethylene-α-olefin copolymer is further functionalized with a hydrocarbyl amine, wherein the hydrocarbyl amine is an aromatic amine.

7. The lubricating composition of claim 6, wherein the acylating agent comprises maleic anhydride and the hydrocarbyl amine comprises 3-nitroaniline.

8. The lubricating composition of claim 1, wherein the ethylene-α-olefin copolymer comprises a copolymer of ethylene and propylene, and wherein the copolymer comprises 30 mol percent to 70 mol percent ethylene.

9. The lubricating composition of claim 1, wherein the poly(meth)acrylate polymer comprises a linear polymer having a weight-average molecular weight of 10,000 Da to 80,000 Da measured by gel permeation chromatography using polystyrene standard.

10. The lubricating composition of claim 1, wherein the first block ($B_1$) comprises an aromatic (meth)acrylayte monomer.

11. The lubricating composition of claim 1, wherein the poly(meth)acrylate polymer has a polymer architecture selected from linear, branched, hyper-branched, cross-linked, star, or combinations thereof.

12. The lubricating composition of claim 1, wherein the polymethacrylate polymer comprises a star polymer having at least 3 arms comprising block or tapered block copolymers.

13. The lubricating composition of claim 1, wherein the metal-free anti-wear agent comprises a metal-free phosphorus compound.

14. The lubricating composition of claim 13, wherein the metal-free phosphorus compound is selected from the group consisting of amine or ammonium salts of (alkyl)phosphoric acid, hydrocarbyl phosphite compounds, hydrocarbyl phosphonate compounds, trihydrocarbyl phosphate compounds, and combinations thereof.

15. The lubricating composition of claim 1, wherein the metal-free anti-wear agent comprises a phosphorus-free and sulfur-free organic compound.

16. The lubricating composition of claim 15, wherein the phosphorus-free and sulfur-free organic compound is an ester, amide, or imide of a hydroxyl-substituted hydrocarbyl carboxylic acid compound and mixtures thereof.

17. The lubricating composition of claim 16, wherein the metal-free anti-wear agent is an ester, amide, or imide of tartaric acid, malic acid, citric acid, glycolic acid, lactic acid, and combinations thereof.

18. The lubricating composition of claim 1, further comprising an antioxidant.

19. The lubricating composition of claim 18, wherein the antioxidant comprises a sulfurized olefin antioxidant.

20. The lubricating composition of claim 18, wherein the antioxidant comprises a sulfurized phenolic antioxidant.

21. The lubricating composition of claim 18, wherein the antioxidant comprises a oxyalkylated hydrocarbyl phenol.

22. The lubricating composition of claim 1, further comprising at least one detergent.

23. The lubricating composition of claim 1, wherein the lubricating composition is free of or substantially free of zinc dialkyldithiophosphate.

24. The lubricating composition of claim 1, wherein the base oil has a kinematic viscosity (ASTM D445 test method) measured at 100° C. of 2.4 $mm^2/s$ to 4.6 $mm^2/s$.

25. A method of lubricating an internal combustion engine comprising supplying to the internal combustion engine a lubricating composition comprising the lubricating composition of claim 1.

26. The lubricating composition of claim 1, wherein the second block ($B_2$) which is substantially soluble in the base oil is derived from two or more of $C_8$, $C_9$, $C_{10}$, $C_{11}$, $C_{12}$, $C_{13}$, $C_{14}$, or $C_{15}$ alkyl (meth) acrylate derived units.

27. The lubricating composition of claim 1, wherein the poly(meth)acrylate polymer forms a self-assembled colloidally stable particle in the oil of lubricating viscosity.

28. A lubricating composition comprising (a) a base oil having a kinematic viscosity measured at 100° C. of 2.0 $mm^2/s$ to 5.0 $mm^2/s$;

(b) 0.05 weight percent to 2 weight percent of an amine-functionalized ethylene-alpha olefin copolymer;

(c) 0.3 weight percent to 5 weight percent of a poly(meth) acrylate polymer, wherein the poly(meth)acrylate polymer comprises a block or tapered block copolymer (P) comprising a first block ($B_1$) which is substantially insoluble in the base oil and consists essentially of C1 to C4 alkyl (meth)acrylate derived units and a second block ($B_2$) which is substantially soluble in the base oil and consists essentially of C8 to C24 alkyl (meth) acrylate derived units; and (d) 0.05 weight percent to 5 weight percent of a metal-free phosphorous anti-wear agent: wherein the dynamic viscosity measured according to ASTM D4683 of the lubricating composition under shear at 150° C. is 1.4 mPa·s to 2.8 mPa·s.

29. The lubricating composition of claim 28, wherein the base oil has a kinematic viscosity (ASTM D445 test method) measured at 100° C. of 2.4 $mm^2/s$ to 4.6 $mm^2/s$.

30. The lubricating composition of claim 28, wherein the second block ($B_2$) which is substantially soluble in the base oil is derived from two or more of $C_8$, $C_9$, $C_{10}$, $C_{11}$, $C_{12}$, $C_{13}$, $C_{14}$, or $C_{15}$ alkyl (meth) acrylate derived units.

31. The lubricating composition of claim 28, wherein the poly(meth)acrylate polymer forms a self-assembled colloidally stable particle in the oil of lubricating viscosity.

* * * * *